US008449154B2

(12) United States Patent
Uemoto et al.

(10) Patent No.: US 8,449,154 B2
(45) Date of Patent: May 28, 2013

(54) ILLUMINATION DEVICE INCLUDING A LIGHT-EMITTING MODULE FASTENED TO MOUNT MEMBER WITH A CONSTANT ORIENTATION

(75) Inventors: Takaari Uemoto, Osaka (JP); Yasuyuki Ueda, Osaka (JP); Mitsuko Shuto, Osaka (JP); Masahiro Miki, Osaka (JP); Makoto Inoue, Hyogo (JP); Hideo Nagai, Osaka (JP); Kenji Takahashi, Osaka (JP); Takeshi Saito, Hyogo (JP)

(73) Assignee: Panasonic Corporation, Osaka (JP)

( * ) Notice: Subject to any disclaimer, the term of this patent is extended or adjusted under 35 U.S.C. 154(b) by 186 days.

(21) Appl. No.: 13/144,681

(22) PCT Filed: Sep. 28, 2010

(86) PCT No.: PCT/JP2010/005820

§ 371 (c)(1),
(2), (4) Date: Jul. 14, 2011

(87) PCT Pub. No.: WO2011/039998

PCT Pub. Date: Apr. 7, 2011

(65) Prior Publication Data

US 2011/0273895 A1 Nov. 10, 2011

(30) Foreign Application Priority Data

Sep. 30, 2009 (JP) ..... 2009-227696

(51) Int. Cl.

| | |
|---|---|
| ***F21V 21/00*** | (2006.01) |
| ***F21V 19/00*** | (2006.01) |
| ***F21S 8/00*** | (2006.01) |

(52) U.S. Cl.
USPC . 362/430; 362/249.11; 362/548; 362/249.01; 362/249.02; 362/647; 313/46; 257/98; 257/99

(58) Field of Classification Search
USPC ..... 362/430, 548
See application file for complete search history.

(56) References Cited

U.S. PATENT DOCUMENTS

| | | | | |
|---|---|---|---|---|
| 7,758,223 | B2 | 7/2010 | Osawa et al. | |
| 8,047,688 | B2 * | 11/2011 | Takahasi et al. | 362/310 |
| 8,246,206 | B2 * | 8/2012 | Hung et al. | 362/249.11 |
| 8,360,606 | B2 * | 1/2013 | Takei et al. | 362/249.01 |

(Continued)

FOREIGN PATENT DOCUMENTS

| | | |
|---|---|---|
| JP | 2005-235778 | 9/2005 |
| JP | 2005-2357778 | 9/2005 |

(Continued)

*Primary Examiner* — Sikha Roy

(57) ABSTRACT

A mount member (5) has a contact surface (27*a*) touching the bottom surface of an LED module (3) and protrusions (5*a*) protruding from the periphery of the contact surface (27*a*) in the thickness direction of the LED module (3) and regulating sliding motions thereof. A fixing member (6) made of a resilient, plate-like member comprises an opposing pair of flat portions (43) near the contact surface (27*a*) of the mount member (5) and flat tabs (44) projecting from the flat portions (43) toward the contact surface (27*a*) touching the upper surface of a substrate (17). The flat portions (43) of the fixing member (6) are fastened to be lower than the top surface of the substrate (17) of the LED module (3). Thus, elastically deformed areas extending from the fastened parts of the flat portions (43) through the flat tabs (44) press the substrate (17) into the mount member (5).

6 Claims, 23 Drawing Sheets

U.S. PATENT DOCUMENTS

| | | | | |
|---|---|---|---|---|
| 8,388,183 | B2 * | 3/2013 | Miki et al. | 362/249.02 |
| 2003/0189829 | A1 | 10/2003 | Shimizu et al. | |
| 2006/0141851 | A1 | 6/2006 | Matsui et al. | |
| 2006/0227558 | A1 | 10/2006 | Osawa et al. | |
| 2010/0237761 | A1 | 9/2010 | Osawa et al. | |
| 2010/0237779 | A1 | 9/2010 | Osawa et al. | |
| 2010/0244650 | A1 | 9/2010 | Osawa et al. | |
| 2010/0244694 | A1 | 9/2010 | Osawa et al. | |
| 2010/0253200 | A1 | 10/2010 | Osawa et al. | |
| 2011/0156569 | A1 | 6/2011 | Osawa | |

FOREIGN PATENT DOCUMENTS

| | | |
|---|---|---|
| JP | 2006-313718 | 11/2006 |
| JP | 4041411 | 11/2007 |
| JP | 4095463 | 3/2008 |
| JP | 2008-198398 | 8/2008 |
| JP | 2009-117371 | 5/2009 |

* cited by examiner

ILLUMINATION DEVICE INCLUDING A LIGHT-EMITTING MODULE FASTENED TO MOUNT MEMBER WITH A CONSTANT ORIENTATION

TECHNICAL FIELD

The present invention pertains to an illumination device using a light-emitting element.

BACKGROUND ART

In recent years, as a measure toward low-energy consumption and global warming prevention, research in the field of lighting has led to an illumination device that uses LEDs (Light-Emitting Diodes) to realize greater energy efficacy than conventional incandescent light bulb technology.

For example, the energy efficacy of existing incandescent light bulbs, on the order of some tens of lumens per watt, can be realized at levels of 100 lm/W and above by using LEDs for the light source (a bulb-shaped illumination device using LEDs and intended as a replacement bulb being hereinafter referred to as an LED light bulb).

Patent Literature 1 proposes an LED light bulb as a replacement for a conventional incandescent light bulb. The LED light bulb described in Patent Literature 1 has a light-emitting module made up of a substrate on which are mounted a plurality of LEDs, the module being fitted onto an end (a surface) of a case comprising a lighting circuit therein, and a dome-shaped globe that covers the LEDs. The outward appearance of this LED light bulb is similar to that of conventional incandescent light bulbs. The LED light bulb uses an Edison screw base as a power supply terminal, and can thus be fixed into a light fixture made for use with conventional incandescent light bulbs.

In the above-described LED light bulb, the light-emitting module is fixed onto the surface of the case by screwing through the middle with penetrating screws.

Nevertheless, the heat generated by the light-emitting module during luminescence must be transmitted through the case (acting as a heat sink) or similar. There is thus a need for the case or the like to be in contact with the bottom surface of the light-emitting module.

As such, technology has been developed in which the light-emitting module is fixed onto a mount member of the case or heat sink such that the bottom surface of the light-emitting module is in contact with the mount member. There, a socket for the light-emitting module is fastened onto the mount member (heat sink) with the exception of the portion of the light-emitting module on which the LEDs are mounted (portion hereinafter termed light-emitting unit) (see Patent Literature 2 and 3). The socket has a plurality of compression springs that, upon receiving the light-emitting module placed on the mount member (heat sink), presses the top side of the area surrounding the light-emitting unit of the light-emitting module toward the mount member (heat sink). Being pressed toward the mount member by the compression springs, the bottom surface of the light-emitting module is brought into contact with the mount member. The compression springs are capable of regulating the movement (sliding) of the light-emitting module on the mount member.

CITATION LIST

Patent Literature

[Patent Literature 1]
Japanese Patent Application Publication No. 2006-313718
[Patent Literature 2]
Japanese Patent No. 4041411
[Patent Literature 3]
Japanese Patent No. 4095463

SUMMARY OF INVENTION

Technical Problem

However, in the LED light bulb, the light-emitting unit of the LED module must be placed in the middle of the top surface of the mount member (i.e., arranged such that the center of the light-emitting unit is aligned with the central axis of the LED light bulb). Given a light-emitting module in which multiple LEDs are mounted at the center of the substrate with high density, the technology proposed in Patent Literature 1, where the light-emitting module is fixed onto the mount member by use of penetrating screws at the center thereof, cannot be used because of the presence of LEDs in the middle.

Also, given that springs add to the weight of a socket, problems arise when the light-emitting module is to be fit onto the mount member by use of a socket as described in Patent Literature 2 and 3. Constructing a socket with a plurality of compression springs strong enough to regulate the movement of the light-emitting module while still exerting a strong pressing force is a complex task.

The above-described problems also arise in illumination devices other than LED light bulbs, whenever a light-emitting module comprising a light-emitting element at the center of a light-emitting unit is made to fit on a mount member.

In order to solve the above problems, the present invention aims to provide an illumination device in which a light-emitting module can be made to fit on a mount member through a simple structure that does not add to the total weight.

Solution to Problem

The illumination device pertaining to the present invention is an illumination device including a light-emitting module having a substrate and a light-emitting unit mainly constituted by a light-emitting element on a central portion of a top surface of the substrate, the light-emitting module being fixed to a mount member by a pressing member, wherein the mount member has a contact surface in contact with a bottom surface of the light-emitting module mounted thereon, and a regulating portion regulating sliding motions of the light-emitting module in protruding from near the contact surface along the thickness dimension of the light-emitting module, and the pressing member presses the light-emitting module into the contact surface due to forces applied by the pressing member fastened to the mount member with a constant orientation, the light emitting module being disposed on the contact surface while the sliding motions thereof are regulated by the regulating portion.

The illumination device here referenced includes bulb-shaped illumination devices intended to replace incandescent light bulbs and screw-in fluorescent lamps (i.e., lamps possessing a lighting circuit), and compact lamps (i.e., lamps not possessing a lighting circuit), and further includes new types of illumination devices not intended to replace conventional lighting devices.

Advantageous Effects of Invention

According to the above structure, the presence of the regulating portion on the mount member enables regulation of sliding movement of the light-emitting module along the contact surface of the mount member with a simple construction. In addition, the pressing member is structured so as to press the light-emitting module into the contact surface as a result of the forces applied when fastened to the mount member with a constant orientation. The light-emitting module (substrate) is pressed into the mount member (contact portion) by fixing the pressing member. The light-emitting module is thus be fixedly fastenable onto the mount member with a simple construction.

Also, the pressing member is made of a resilient plate-like member and comprises flat portions disposed in areas peripheral to the contact surface of the mount member, and flat tabs reaching from the flat portions toward the contact surface and coming into contact with the top surface of the substrate of the light-emitting module, and the pressing member is fastened such that the flat portions come to be positioned lower than the top surface of the substrate of the light-emitting module, thereby causing the flat tabs of the pressing member to press the light-emitting module due to forces applied by elastic deformation in a region extending from a fastened area of the flat portions to the flat tabs.

Furthermore, a top surface of the regulating portion of the mount member is lower than the top surface of the substrate, and the flat portions of the pressing member are fastened to the top surface of the regulating portion. Alternatively, the flat portions are provided as an opposing pair sandwiching the light-emitting unit therebetween, the flat tabs are individually provided on each of the flat portions, and a total of two flat tabs are positioned so as to exhibit point symmetry about the center of the light-emitting unit.

In addition, the light-emitting module has terminals electrically connected to the light-emitting element provided as an opposing pair at positions not facing the flat portions on the top surface of the substrate, and the terminals are pressed toward the contact surface by the pressing member. Alternatively, the terminals of the light-emitting module are electrically connected to a connection terminal member disposed between the pressing member and the substrate of the light-emitting module, and the connection terminal member is pressed toward the contact surface by the pressing member so as to press the terminals of the light-emitting modules.

Also, the pressing member has a projecting portion that projects between the connection terminal member and the light-emitting unit, and an edge of the projecting portion projects to the substrate or to a vicinity thereof.

Further, the pressing member is made of a resilient flat plate, and comprises: flat portions disposed in areas peripheral to the light-emitting unit of the light-emitting module; extensions extending from the flat portions toward the contact surface; and convexities formed in the extensions along the thickness dimension of the light-emitting module and reaching toward the substrate, and the pressing member is fastened such that the flat portions come to be positioned closer to the mount member than a base position of the convexities, thereby causing the convexities of the pressing member to press the light-emitting module due to forces applied by elastic deformation in a region extending from a fastened area of the flat portions to the extensions.

Alternatively, the mount member has elongations leaving a space between the mount member and the regulating portion and reaching a vicinity of the light-emitting unit of the light-emitting module on the contact surface, and the pressing member has a part having a volume greater than the space between the regulating portion and the light-emitting module, and portions of the pressing member in contact with the light-emitting module press the light-emitting module due to forces applied by the part being sandwiched in the space between the extensions and the light-emitting unit.

BRIEF DESCRIPTION OF DRAWINGS

FIG. 23B shows positions near a virtual line joining midpoints.

DESCRIPTION OF EMBODIMENTS

A bulb-shaped illumination device pertaining to the Embodiments of the present invention is described below with reference to the drawings.

Embodiment 1

1. Configuration

Figure 1:
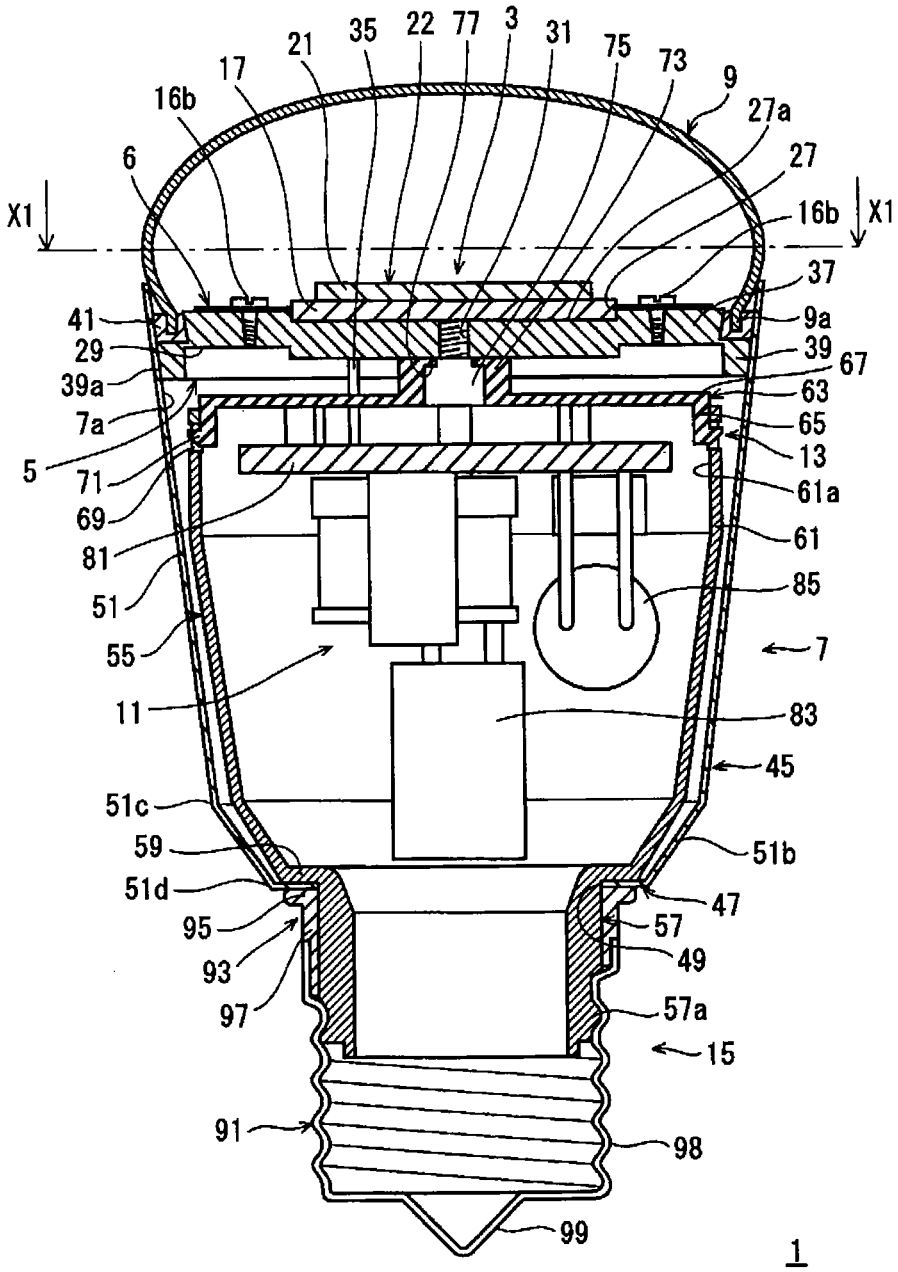
FIG. 1 shows a cross-sectional diagram of a bulb-shaped illumination device pertaining to Embodiment 1.
Figure 2:
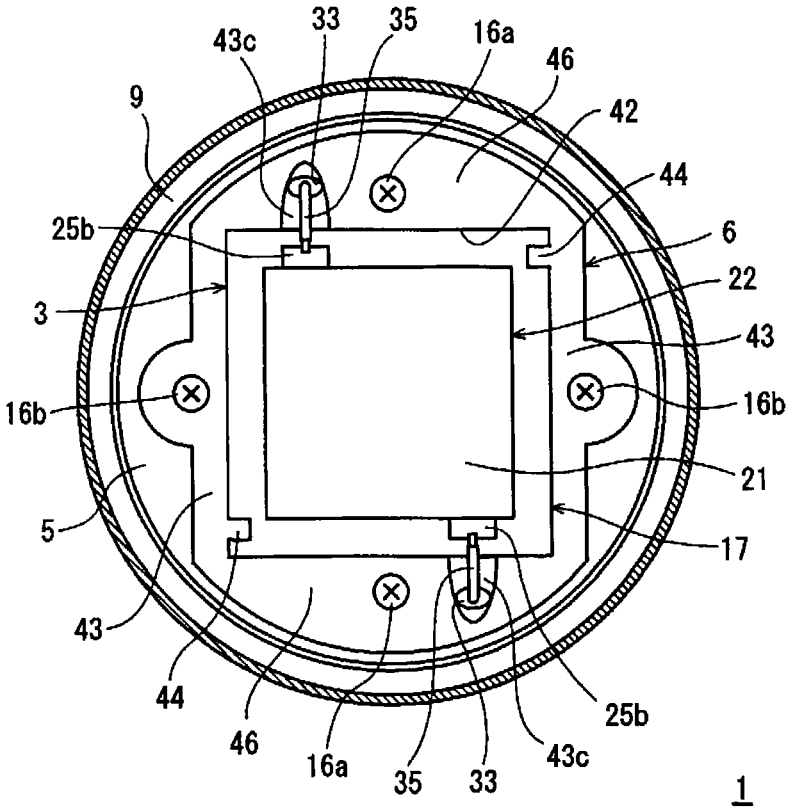
FIG. 2 shows a cross-sectional diagram taken along the line X1-X1 of FIG. 1 as viewed from the direction indicated by the arrows.

FIG. 1 is a longitudinal cross-sectional diagram of a bulb-shaped illumination device pertaining to Embodiment 1. FIG. 2 shows a cross-section taken along the line X1-X1 of FIG. 1 as viewed from the direction indicated by the arrows.

As shown in FIG. 1, the bulb-shaped illumination device (hereinafter termed LED light bulb) 1 comprises an LED module (corresponding to the light-emitting module of the present invention) 3 that in turn comprises a plurality of LEDs (corresponding to the light-emitting element of the present invention) as a light source, a mount member 5 on which the LED module is mounted, a fixing member (corresponding to the pressing member of the present invention) 6 for fixing the LED module on the mount member 5, a case 7 that has the mount member 5 at one end thereof, a globe 9 that covers the LED module 3, a lighting circuit 11 that lights the LEDs (causes the LEDs to emit light), a circuit casing 13 that contains the lighting circuit 11 therein and that is arranged within the case 7, and a base member 15 arranged at another end of the case 7. The fixing member 6 is, for example, affixed to the mount member 5 by two each of screw members 16*a* and 16*b*.

(1) LED Module 3

Figure 3:
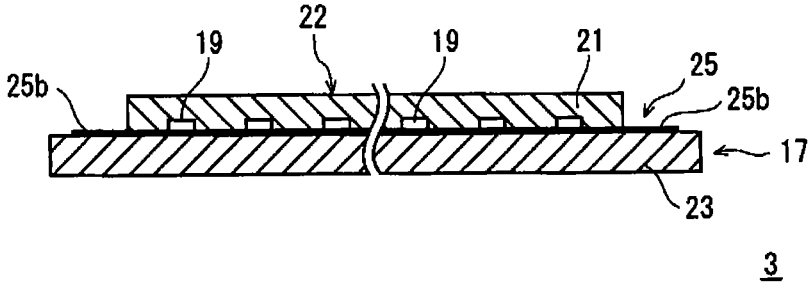
FIG. 3 shows a cross-sectional diagram of an LED module.

FIG. 3 is a cross-sectional diagram of the LED module.

The LED module 3 comprises a substrate 17, a plurality of LEDs 19 mounted on a principal surface of the substrate 17, and sealant 21 that envelops the LEDs 19. The quantity, connection method (serial or parallel) and other characteristics of LEDs 19 are determined so as to provide luminous flux and the like appropriate to the requirements of the LED light bulb 1. The principal surface of the substrate 17 on which the LEDs 19 are mounted is termed the LED mounting surface. The LEDs 19 and the sealant 21 are together termed a light-emitting unit 22 as the sealant 21 is made to output light by the light emission of the LEDs 19.

The substrate 17 comprises a body 23 and a wiring pattern 25 provided thereon. The body 23 is, for instance, made of an insulating material. The wiring pattern 25 formed on a principal surface of the body.

The wiring pattern 25 has a connector 25*a* for connecting the plurality of LEDs 19 according to a predetermined serial, parallel, or other connection method, and two terminals 25*b* connected to lead wires 35 which are, in turn, connected to the lighting circuit 11.

The LEDs 19 are semiconductor light-emitting elements that emit light of a predetermined color. The sealant 21 not only seals the LEDs 19 so as to prevent contact with outside air but also converts the wavelength of the light emitted by the LEDs, in whole or in part, into a predetermined wavelength.

The sealant 21 is, for example, made of a translucent material and a converting material, the latter being able to convert the light emitted by the LEDs 19 into predetermined wavelengths.

(2) Mount Member 5

The LED module 3 is mounted on the mount member 5. The mount member 5 closes an open end of the case 7, which, as described later, is tubular, by being in internal contact therewith. Specifically, as shown in FIGS. 1 and 2, the mount member 5 is board-shaped, has an outer perimeter that nearly conforms to the inner perimeter of the open end of the case 7 when seen in a plan view (from a direction extended from the central axis of the LED light bulb 1), and closes the open end of the case 7 by being fit therein. The LED module 3 is mounted on the mount member 5 through the fixing member 6 at a position (the upper portion of FIG. 1) on a surface (hereinafter considered the top surface) exterior to the case 7. In this example, the case 7 is in the shape of a tube with an annular cross-section (more succinctly: a cylinder) and thus, the mount member 5 is shaped as a round board.

As shown in FIG. 1, the mount member 5 has a recess 27 (see FIG. 7) in which to carry the LED module 3 formed in the top side thereof, weight-reducing recesses 29 formed in the bottom side thereof, and a central female screw 31 in which to thread a male screw serving as a coupling member 75 for coupling the mount member 5 with the later-described circuit casing 13.

The female screw 31 may pass completely through or only partially through the mount member 5. In the latter case, the female screw 31 is provided at the approximate centre of the bottom surface of the mount member 5.

The recess 27 has nearly the same shape as the LED module 3 when seen in a plan view. The LED module 3 is fit into the recess 27 such that the bottom of the recess 27 and the substrate 17 of the LED module 3 are in surface contact.

The bottom of the recess 27 acts as a contact surface 27*a*, which is in contact with the bottom surface of the substrate 17 of the LED module 3. With reference to the contact surface 27*a*, a protrusion is formed extending upward (in the thickness direction of the substrate 17) from the surrounding area, corresponding to the regulating portion of the present invention.

The depth (height) of the recess 27 is, as shown in FIG. 1, less than the height of the substrate 17. Specifically, with reference to the contact surface 27*a*, the amount by which the protrusion protrudes is less than the thickness of the substrate 17. When the LED module 3 is arranged in the recess 27, the top surface of the substrate 17 comes to be higher than the top surface of the mount member 5, excluding the recess 27. Not only does the recess 27 allow the LED module 3 to be positioned easily and accurately, but movement (sliding) of the LED module 3 along the contact surface 27*a* (bottom) of the recess 27 can also be regulated.

As shown in FIG. 2, the mount member 5 comprises through-holes 33 penetrating through the thickness dimension thereof. The lead wires 35 pass through the through-holes 35 from the lighting circuit 11 and are electrically connected to the terminals 25*b* of the substrate 17 (such as by using solder or the like). The mount member 5 should comprise at least one through-hole 33. In the minimal case, two lead wires (35) may pass through one through-hole (33). Alternatively, if there are two through-holes 33, then two lead wires 35 each pass through a different one of the through-holes 33.

The mount member 5 has a gradation the along entire outer perimeter thereof, spanning from the top surface to the bottom surface. Specifically, the gradation is formed by the diametrical difference between a narrow-diameter portion 37 having a short outer diameter and a wide-diameter portion 39 having a longer outer diameter than the narrow-diameter portion 37. The surface of the outer perimeter 39*a* of the wide-diameter portion 39 is in contact with the inner face 7*a* of the case 7.

A space is formed between the inner face 7*a* of the case 7 and the narrow-diameter portion 37 in which the open end 9*a* of the globe 9 is inserted. Once inserted, the open end 9*a* of the globe 9 is fastened using an adhesive 41, for example.

The outer perimeter 39*a* of the wide-diameter portion 39 is slanted such that the outer diameter is gradually reduced over the distance from the edge nearer to the narrow-diameter portion 37 (the top edge in FIG. 1) to the edge farther from the narrow-diameter portion 37 (the bottom edge in FIG. 1). The angle of this slant matches that of the later-described inner face 7*a* of the case 7.

(3) Fixing Member 6

Figure 4:
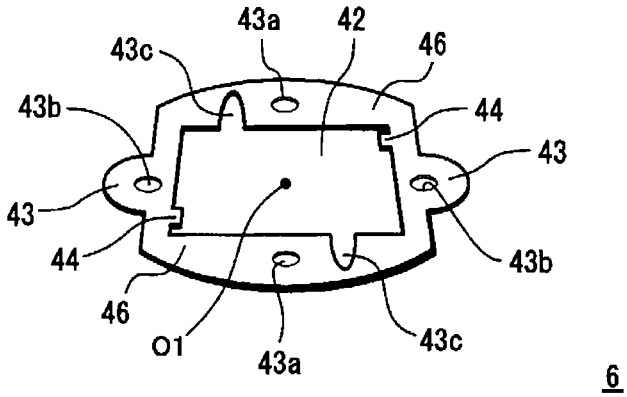
FIG. 4 shows a perspective view of a fixing member pertaining to Embodiment 1.

FIG. 4 is a perspective view of the fixing member 6 pertaining to Embodiment 1.

The fixing member 6 is formed from a single plate-like member and has a central opening 42 for the LED module 3. The central opening has an outer portion (43) threaded onto the mount member 5 by two each of the screw members 16*a* and 16*b* (see FIG. 2).

As shown in FIG. 2, the shape of the opening 42 corresponds to the external dimensions (outer shape) of the LED module 3. Seen in a plan view, the shape of the fixing member 6 is such that parts (44) on opposite sides of the periphery delimiting the opening 42 reach toward the center (reach toward the opposite side of the periphery).

To be precise, the fixing member 6 is formed of a resilient material in a plate-like shape and comprises a pair of flat portions 43 arranged on the peripheral portion (the top surface 5*a* of the mount member, which, relative to the contact surface 27*a*, is the top of the protrusion) of the contact surface 27*a* of the mount member 5, two flat tabs (corresponding to the flat tabs of the present invention) 44 reaching from the flat portions 43 so as to be above the contact surface 27*a*, and flat coupling portions 46 that couple the ends of the pair of flat portions 43. The fixing member 6 also has a pair of notches 43*c* to accommodate the lead wires 35 connected to the lighting circuit 11. Also, the dimensions of the opening 42 are greater than those of the LED module 43.

The flat tabs 44 are provided at opposing positions sandwiching the center of the light-emitting unit 22 (point O1 in FIG. 4). Embodiment 1 in particular provides the flat tabs 44 at positions having point symmetry about the center (O1) of the light-emitting unit 22.

When the flat portions 43 of the fixing member 6 are fastened to the top surface 5*a* of the mount member 5 by the screw members 16*a* and 16*b*, regions spanning the flat portions 43 from the fastened portions thereof (the area surrounding the screw holes 43*a* and 43*b* in FIG. 4) through the flat tabs 44 undergo elastic deformation resulting from the difference in height between the top surface 5*a* of the mount member 5 and the top surface of the substrate 17 (the top surface of the substrate 17 being higher than the top surface 5*a* of the mount member 5). As a result, the LED module 3 is pressed into the contact surface 27*a* of the mount member by the restoring force exerted against the elastic deformation.

(4) Case 7

As shown in FIG. 1, the case 7 is in the shape of a tube open at both ends, the above-described mount member 5 being attached thereto at one end and the base member 15 being attached at the opposite end, and contains the circuit casing 13 in the inner space thereof. The lighting circuit 11 is held (contained) within the circuit casing 13.

The case 7 has a tubular wall 45 and a bottom wall 47 provided at the opposite end of the tubular wall 45. A mouth (through-hole) 49 is provided in the center portion (including the central axis of the tube) of the bottom wall 47. With reference to the open ends of the case 7, which is tubular, the open end with the wider diameter is called the large opening, and the open end with the narrower diameter is called the small opening. The small opening is given the reference symbol 49.

The tubular wall 45 has sloped portions 51*a* and 51*b* positioned about the central axis thereof, extending from the edge of the large opening to the bottom wall 47, and angled such that the inner and outer diameters of the case are gradually reduced. The sloped portions 51*a* and 51*b* are simply referred to with the symbol 51 when there is no need to distinguish the pair.

In Embodiment 1, the sloped portion 51*a*, which is closer to the large opening, is sloped at an angle from the central axis that is less oblique than that of the sloped portion 51*b*, which is closer to the bottom wall 47.

As described above, the case 7 is in the shape of tube having a first sloped portion 51*a*, a second sloped portion 51*b*, and a bottom wall 47. A first flexure 51*c* is located at the transition between the first sloped portion 51*a* and the second sloped portion 51*b*, and a second flexure 51*d* is located at the transition between the first sloped portion 51*a* and the bottom wall 47.

The heat generated by the LEDs 19, once illuminated, is dissipated to the atmosphere mainly by transmission from the substrate 17 of the LED module 3 to the mount member 5, and then from the mount member 5 through the case 7. To this end, the case 7 is configured to dissipate the heat generated by the lit LEDs 19 to the atmosphere and can thus be called a heat sink. The mount member 5, being configured to transfer the heat from the LED module 3 to the case 7, can be termed a thermo-conductive member. As described below, the outer surface of the case 7 undergoes an anodizing process to enhance the heat-dispersing qualities thereof.

The mount member 5 may be fixed to the case 7 by, for example, pressing the mount member 5 into the large open end of the case 7. The mount member 5 is positioned by matching the angle of slant of the outer perimeter 39*a* thereof to that of the inner face 7*a* of the case 7.

In order to prevent the mount member 5 from falling out of the case 7, a protrusion is formed so as to protrude from an area of the case 7 that is in contact with the mount member 5 or that is closer to the large opening than the edge of the mount member 5 nearest the large opening (i.e., the upper edge margin area that is above the top edge margin of the mount member 5) toward the interior (the central axis of the case 7). The protrusion may be formed, for instance, by punching in the outer face of the case 7 at the appropriate position.

(5) Circuit Casing 13

The circuit casing 13 comprises a body 55 arranged inside the case 7 and an extruded tubular portion 57 in the shape of a tube extruded from the body 55 out of the case 7 through the small opening 49 thereof.

The body 55 is too large to pass through the small opening 49 of the case 7. When the extruded tubular portion 57 is extruded through the small opening 49, a contact portion 59 of the body 55 comes into contact with the inner surface of the bottom wall 47 of the case 7.

The circuit casing 13 is made up of a tubular body 61 arranged inside the case 7 with one part thereof extruded from the case 7 through the small opening 49, and of a lid 63 that closes an opening 61*a* of the tubular body 61 arranged inside the case 7.

To be precise, the body 55 of the circuit casing 13 is the portion thereof arranged within the case 7 and made up of the tubular body 61 and of the lid 63, while the extruded tubular portion 57 of the circuit casing 13 is the portion extruded out of the case 7 from the tubular body 61 through the small opening 49. The outer circumferential surface face of the extruded tubular portion 57 may be wholly or partially formed into a screw portion 57*a* in order to fix the base member 15 thereon.

The lid 63 is shaped as a bottomed cylinder, having a tubular portion 65 and a cover 67. The tubular portion 65 is constructed for insertion into the wide-diameter edge of the tubular body 61 (needless to say, the tubular body 61 may alternatively be constructed for insertion into the lid 63).

Figure 5:
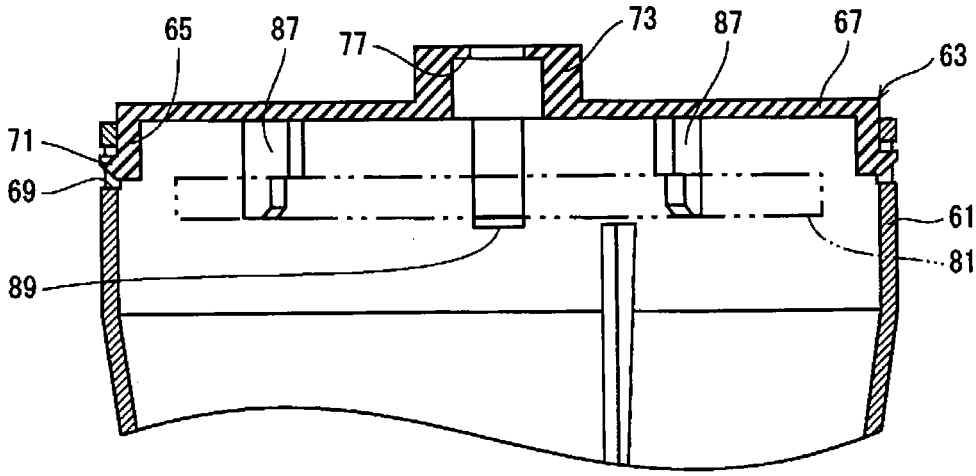
FIG. 5 shows a cross-sectional diagram illustrating the mounting of a substrate in a circuit casing.

As shown in FIG. 5, the lid 63 has a plurality (two in this example) of engaging claws 71 on the tubular portion 65 thereof that engage with a plurality of (two in this example) engaging holes 69 formed in the wide-diameter edge of the tubular body 61. When inserted in the tubular body 61, the tubular portion 65 is adjustably fixed thereon by the engaging claws 71, which engage with the engaging holes 69. Alternatively, the engaging holes may be formed on the tubular portion and the engaging claws may be formed on the tubular body in a configuration opposite that described above, provided that mutual engagement ensues.

The engaging holes 69 on the tubular body 61 are configured to be larger than the engaging claws 71 on the lid 63, which are introduced therein. Specifically, as shown in FIG. 5, the engaging holes 69 on the tubular body 61 are elongated (i.e., are elliptical) in the direction in which the tubular portion 65 of the lid 63 is inserted into the tubular body 61 (toward the central axis of the tubular body 61). The shape of the engaging holes 69 is thus, for example, oblong. Therefore, the lid 63 can be attached to the tubular body 61 so as to be adjustable in the insertion direction.

The lid 63 has a central protruding portion 73 shaped as a bottomed cylinder that protrudes toward the mount member 5. The protruding portion 73 has a through-hole in the base 77 thereof. The leading edge of the protruding portion 73 is level and comes into contact with the bottom surface of the mount member 5 when the lid 63 is coupled therewith.

A male screw serving as the coupling member 75 that couples the circuit casing 13 and the mount member 5 is inserted into the protruding portion 73. Upon insertion, the (underside of) the male screw head comes into contact with the base 77 of the protruding portion 73. Thus, the insertion of the coupling member 75 into the protruding portion 73 can be regulated.

As described later, the fixing of the circuit casing 13 in the case 7 is accomplished by sandwiching the bottom wall 47 of the case 7 between the contact portion 59 of the circuit casing 13 and the base member 15.

Air pockets are found in the gaps between the (outer surface of the) circuit casing 13 and the inner face 7*a* of the case 7, excluding the area of the contact portion 59 and the extruded tubular portion 57, and in the gaps between the (outer surface of the) circuit casing 13 and the bottom surface of the mount member 5, excluding the area of the protruding portion 73 of the lid 63.

Therefore, despite temperature increases in the case 7 due to the lighting of the LED light bulb 1, rising temperatures in the circuit casing 13 can be constrained by the presence of the air pockets between the case 7 and the circuit casing 13. Extreme internal temperature increases can thus be prevented in the lighting circuit 11.

Also, if a great force (such as force sufficient to cause inward compression) is applied, there is a risk of distortion or damage to the case 7 as the thickness thereof is between 200 μm and 500 μm, inclusive. However, given that the lighting circuit 11 is contained in the circuit casing 13, which is held within the case 7 with air pockets (gaps) acting as intermediaries, damage to the lighting circuit 11 can be avoided in spite of damage to the case 7.

(6) Lighting Circuit 11

The lighting circuit 11 lights up the LEDs 19 using commercial electric power supplied thereto via the base member 15. The lighting circuit 11 is made up various electronic components 83, 85, and so on, which are mounted onto a substrate 81 and comprise, for example, rectifiers and smoothing circuits, DC/DC converters and the like. For the sake of convenience, the various electronic components are referred to with the reference numbers 83 and 85.

The above-described electronic components 83 and 85 are mounted on a principal surface of the substrate 81. The substrate 81 is held within the circuit casing 13 such that the electric components 83 and 85 face the position of the extruded tubular portion 57 of the circuit casing 13. The lead wires 35, being connected to the LED module 3, are attached to the opposite principal surface of the substrate 81.

FIG. 5 is a cross-sectional diagram illustrating the mounting of the substrate in the circuit casing.

In FIG. 5, for ease of explanation of the substrate mounting, only the substrate 81 is drawn using a virtual line.

The substrate 81, on which are mounted the electronic components 83, 85, and so on that compose the lighting circuit 11, is held by a clamp mechanism incorporating a plurality of regulating arms 87 and a plurality of latching claws 89 formed on the lid 63.

The regulating arms 87 and the latching claws 89 here number four each, are disposed in alternation at equidistant intervals along the circumferential direction of the lid 63, and are formed so as to reach from the cover 67 toward the base member 15.

Each of the regulating arms 87 has a hook-shaped tip and is in contact with the surface and the circumferential surface of the substrate 81 nearest the cover 67. Each of the latching claws 89 is in contact with (engages with) the principal surface of the substrate 81 nearest the base member 15. The substrate 81 is thereby fixedly held at a predetermined position within the circuit casing 13.

The substrate 81 is held in place independently of the tubular body 61 and the lid 63 that make up the circuit casing 13, e.g., without directly touching the tubular body 61 and the lid 63. Therefore, the heat transmitted to the substrate 81 when the LEDs 19 are illuminated can be constrained even though the circuit casing 13 and the mount member 5 are, for instance, in contact through coupling by the coupling member 75.

(7) Globe 9

The globe 9 is, for example, dome-shaped, being provided so as to cover the LED module 3 from above. In this example, the open end 9*a* of the globe 9 is inserted into the space between the inner face 7*a* of the case 7 and the (perimeter of the) narrow-diameter portion of the mount member 5. The globe 9 then adheres to the case 7 due to the adhesive 41 disposed between the case 7 and the narrow-diameter portion 37. The adhesive 41 may also fix the mount member 5 to the case 7.

(8) Base Member 15

The base member 15 is attached to a light fixture socket so as to receive power supplied therefrom. The base member 15 is made up of an Edison screw base 91 and an external fitting portion 93, the latter being fixed into the open end of the base 91 and into the outer circumference of the extruded tubular portion 57 of the circuit casing 13.

The external fitting portion 93 is annular, having an inner, diameter that corresponds to the outer diameter of the extruded tubular portion 57. When the external fitting portion 93 is fixed (externally fit) into the extruded tubular portion 57, a case contact portion 95 comes into contact with the bottom wall 47 of the case 7, and a circuit casing contact portion 97 comes into contact with the extruded tubular portion 57.

The base 91 has a shell 98 serving as a screw and an eyelet 99 serving as the tip thereof. The shell 98 screws into the screw portion 57*a* formed in the outer circumference of the extruded tubular portion 57 of the circuit casing 13. The connection lines electrically connecting the lighting circuit 11 and the base 91 are omitted from the diagram in FIG. 1.

2. Example

The LED light bulb 1 pertaining to Embodiment 1 can, for example, be realized in forms corresponding to 60 W and 40 W incandescent light bulbs. The LED light bulb corresponding to a 60 W incandescent light bulb is termed 60 W-equivalent, and the LED light bulb corresponding to a 40 W incandescent light bulb is termed 40 W-equivalent.

(1) LED Module 3

The body 23 of the substrate 17 may be made of resin or ceramic material, for example. However, use of a highly thermo-conductive material is preferable. The body 23 has a thickness of 1 mm. In the present Embodiment, a ceramic material is used.

Also, the body 23 is square-shaped, as seen in a plan view. Each edge thereof is 21 mm long for the 40 W-equivalent light bulb and 26 mm long for the 60 W-equivalent light bulb. Therefore, the contact surface area between the substrate 17 and the mount member 5 is of 441 $mm^2$ or 676 $mm^2$ for each light bulb.

If intended to replace an incandescent light bulb, the LEDs 19 use GaN, for instance, to emit blue light. Then, a silicone resin or similar is used as a translucent material. Then, a material such as YAG phosphor ($(Y, Gd)_3Al_5O_{12}:Ce^{3+}$), silicate phosphor ($(Sr, Ba)_2SiO_4:Eu^{2+}$), nitride phosphor ($(Ca, Sr, Ba)AlSiN_3:Eu^{2+}$), oxynitride phosphor ($Ba_3Si_6O_{12}N_2:Eu^{2+}$) or the like is used as a converting member. White light is thus radiated by the LED module 3.

The LEDs 19 are mounted on the substrate 17 in a matrix arrangement, a concentric circular or polygonal arrangement, a cross arrangement, or the like. The quantity of LEDs 19 is chosen so as to match the luminescence and other qualities of the incandescent light bulb being replaced. For example, the 60 W-equivalent light bulb has 96 LEDs 19 arranged as 4 parallel-connected rows of 24 serial-connected units in a 24×4 matrix, and the 40 W-equivalent light bulb has 48 LEDs 19 arranged as 2 parallel-connected rows of 24 serial-connected units in a 24×2 matrix.

(2) Mount Member 5

The mount member 5 is made of a highly thermo-conductive material, such as Al. The portion on which the LED module 3 is mounted has a thickness of 3 mm, and has a thickness of 3 mm where the mount member 5 meets the wide-diameter portion 39 of the case 7. The outer diameter of the wide-diameter portion 39 is of 37 mm for the 40 W-equivalent light bulb and 52 mm for the 60 W-equivalent light bulb.

(3) Fixing Member 6

The fixing member 6 is made of a resilient material, such as stainless steel, at a thickness of 0.3 mm. The thickness of the fixing member 6 is the same for both the 40 W-equivalent and 60 W-equivalent light bulbs.

The dimensions of the flat tabs 44 are a length of 2.4 mm for the 40 W-equivalent light bulb and of 2.2 mm for the 60 W-equivalent light bulb in the direction of protrusion, and a width of 1.6 mm for the 40 W-equivalent light bulb and of 1.8 mm for the 60 W-equivalent light bulb.

(4) Case 7

The case 7 is made of a highly thermo-dispersive material, such as Al, with a thickness that falls in a range of 0.3 mm to 0.35 mm, inclusive. Given that the flexures 51*c* and 51*d* can serve as girders when the case 7 is made thin, deformation of the case 7 as a whole can be constrained. The dimensions of the case 7 vary according to the type of incandescent light bulb to be replaced.

The surface of the case 7 undergoes an anodizing process and thus has an anodized layer of 10 μm. The volume and weight of the case 7 are not significantly affected by the anodizing process due to the fine film thickness thereof.

If Al is used for the case 7, as in the present Embodiment, then an anodized layer can be formed on the surface thereof through anodic oxidation. Thus, problems caused by applying paint or other materials to the surface, such as peeling and the like, can be avoided even as processing is simplified.

(5) Circuit Casing 13

The circuit casing 13 is made of a low-relative-density material in order to reduce the weight thereof. For example, a synthetic resin (specifically, polybutylene terephthalate (PBT)) may be used.

The lid 55 has a thickness of 0.8 mm, and the tubular body 61 also has a thickness of 0.8 mm.

The gaps between the circuit casing 13 and the case 7 are of approximately 0.5 mm when measured at the middle portion of the central axis of the case 7. Therefore, even if a compressive force (e.g., force that would cause indentation) is applied to the middle of the case 7, the part of the case 7 thereby deformed comes into contact with the circuit casing 13 and is thus prevented from further deformation. Then, if the deformation is elastic in nature, the former shape of the case will be restored once the compressive force ceases to be applied.

A configuration without gaps between the circuit casing 13 and the case 7 is also possible.

By applying a surface treatment to the inside of the case 7 with an insulating material, the case 7 can be insulated from the lighting circuit 11 without involving the circuit casing 13. If the circuit casing 13 is not used, then the resulting light bulb can be further miniaturized and lightened.

(6) Base 91

The base 91 is a base member of the same type as that used in a conventional incandescent light bulb. Specifically, an E26 Edison screw is used for the 60 W-equivalent light bulb and an E17 Edison screw is used for the 40 W-equivalent light bulb.

3. Assembly

Figure 6C:
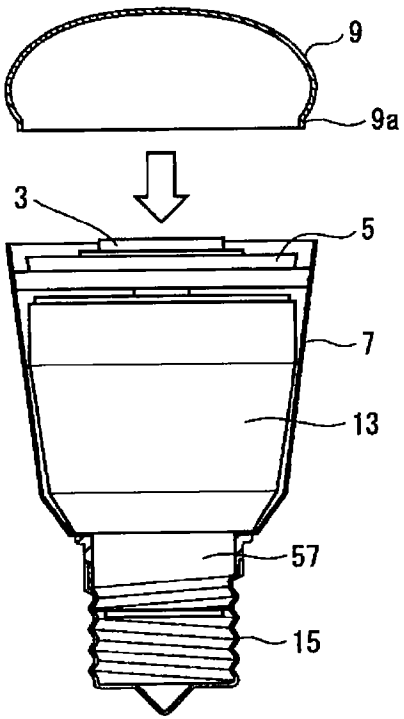
FIGS. 6A, 6B, and 6C illustrate an assembly method for the LED light bulb pertaining to Embodiment 1.
Figure 6B:
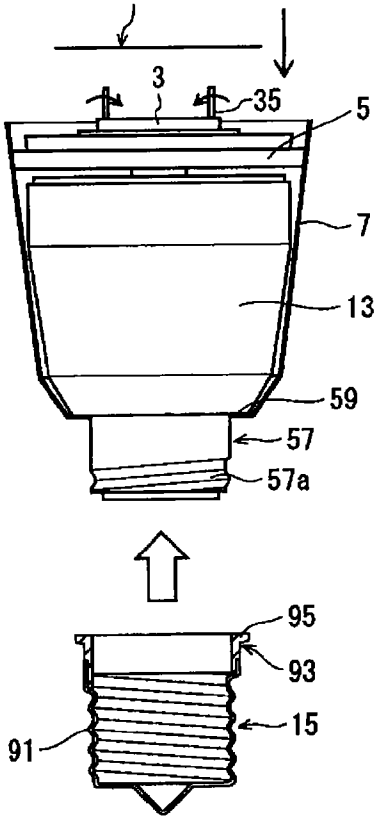
Figure 6A:
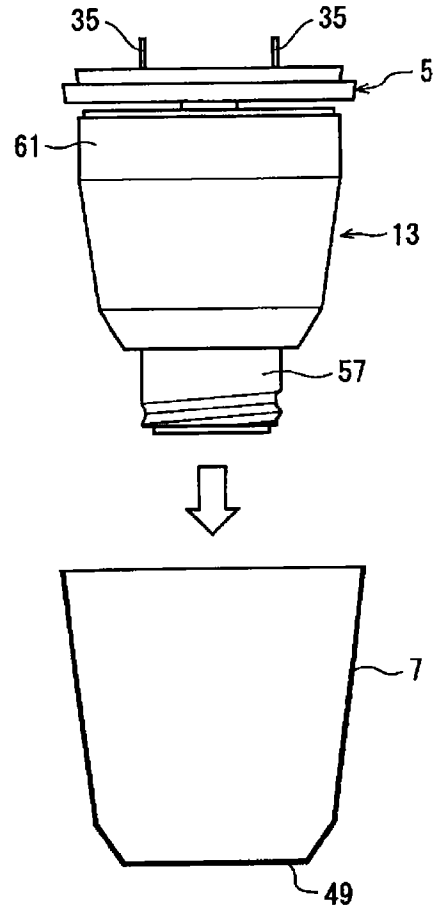

FIGS. 6A, 6B, and 6C are diagrams illustrating the assembly method of the LED light bulb pertaining to Embodiment 1.

First, the mount member 5 and the lid 63 of the circuit casing 13 are coupled by the coupling member 75. Afterward, the substrate 81 of the lighting circuit 11 is fixed into the lid 63 of the circuit casing 13. Then, the tubular body 61 is fit onto the lid 63. As shown in FIG. 6A, the assembly (coupling) of the mount member 5 and the circuit casing 13 is thus completed.

Subsequently, as shown in FIG. 6A, the extruded tubular portion 57 of the circuit casing 13 is made to project outward from inside the case 7 through the small opening 49. Meanwhile, the mount member 5 is pressed into the large opening side of the case 7. Then, in order to prevent the mount member 5 from falling out of the case 7, protrusions are formed in the inner face 7*a* by punching or similar indentation methods at positions along the perimeter of the case 7 corresponding to the top edge of the mount member 5 (at the large opening side of the case 7).

Although the case 7 is very thin, the flexures 51*c* and 51*d* can serve as girders so that the case 7 seldom undergoes deformation at this stage of assembly.

Also, the case 7 and the mount member 5 may be brought into contact by slightly indenting the mount member 5 toward the case 7 due to the fact that the angle of slant of the inner face 7*a* of the case 7 at the edge of the large opening side matches that of the outer perimeter 39*a* of the wide-diameter portion 39 of the mount member 5. As such, despite the possibility of gap formation between the two components due to processing variability and the like, stable coupling strength can be obtained by pushing the mount member 5 inward so as to deform the case and ultimately bring the case 7 and the mount member 5 into stable contact.

As shown in FIG. 6B, once the LED module 3 is fit (installed) into the recess 27 of the mount member 5, one end of each lead wire 35 is electrically connected to the terminals 25*b* of the LED module 3, and the LED module 3 is fixed (fastened) onto the mount member 5 using the fixing member 6.

Figure 7A:
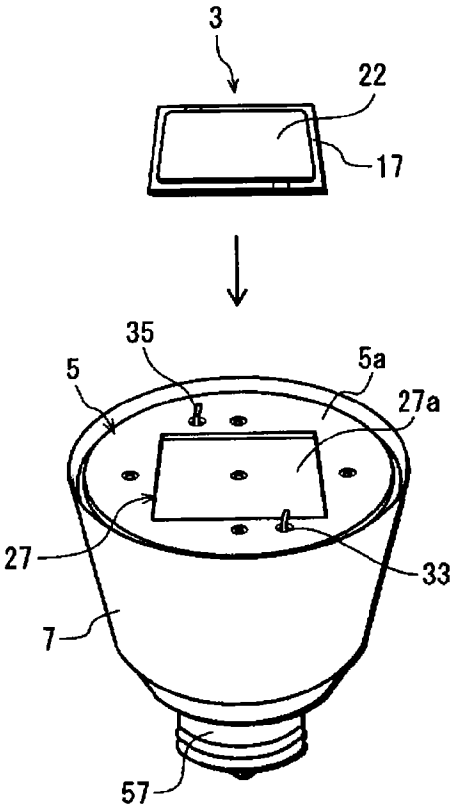
FIGS. 7A, 7B, and 7C illustrate mounting the LED module on a mount member.
Figure 7B:
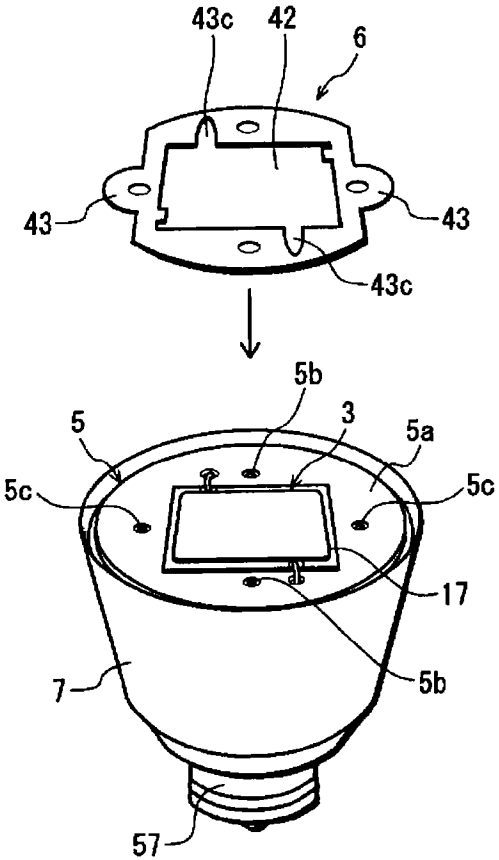
Figure 7C:
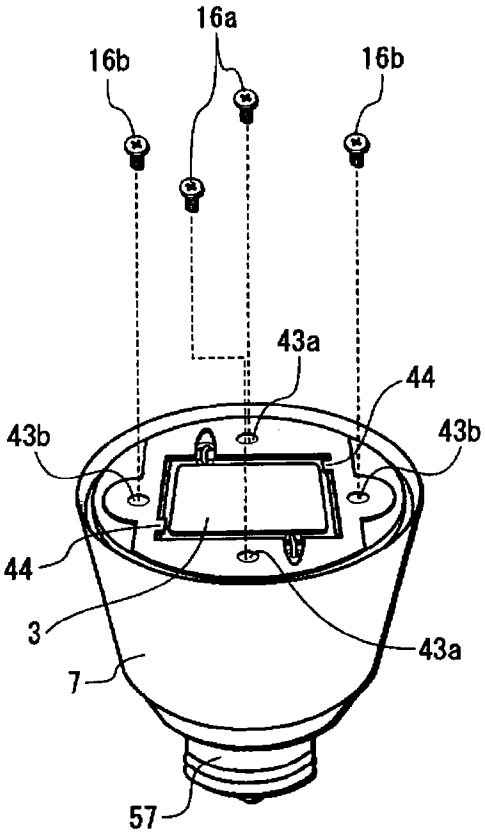

FIGS. 7A, 7B, and 7C are diagrams illustrating the mounting of the LED module 3 on the mount member 5.

First, as shown in FIG. 7A, the LED module 3 is pressed into the recess 27 of the mount member 5 with the terminals 25*b* of the former being oriented so as to be positioned near the through-holes 33 of the latter. The lead wires 35 projecting from the through-holes 33 are electrically connected to each of the terminals 25*b* of the LED module 3.

Next, as shown in FIG. 7B, the flat portions 43 of the fixing member 6 are brought into contact with the top surface 5*a* of the mount member 5 such that the LED module 3 fits into the opening 42 of the fixing member 6. Thus, the flat tabs 44 of the fixing member 6 are brought into contact with the top surface of the substrate 17 of the LED module 3.

Subsequently, as shown in FIG. 7C, two each of the screw members 16*a* and 16*b* traverse holes 43*a* or 43*b* and are respectively screwed into screw holes 5*b* or 5*c* in the mount member 5 until the area surrounding each of the holes 43*a* and 43*b* in the fixing member 6 comes into contact with the top surface 5*a* of the mount member 5.

Accordingly, the fixing member 6 is fastened onto the mount member 5 such that the flat portions 43 are oriented parallel thereto (corresponding to the constant orientation of the present invention). Thus, due to the difference in height existing between the top surface 5*a* of the mount member 5 and the substrate 17 of the LED module 3, a region of the fixing member 6 spanning from the fastened area of the flat portions 43 through to the flat tabs 44 is elastically deformed and pressed into the contact surface 27*a* of the mount member 5 by the restoring force (corresponding to the force applied by fastening the mount member with a constant orientation of the present invention).

That is, movement (sliding) of the LED module 3 in a direction perpendicular to the depth direction of the recess 27 (movement in the plane of the contact surface 27*a*; forward, backward, leftward, and rightward in FIG. 7C) is regulated by the recess 27 of the mount member 5 itself, while movement of the LED module 3 in the depth direction of the recess 27 is regulated by the flat tabs 44 and so on.

Then, as shown in FIG. 6B, the extruded tubular portion 57 is sheathed in the base member 15, which is made to revolve around the screw portion 57*a* at the outer circumference of the extruded tubular portion 57. The base member 15 is thereby screwed into the screw portion 57*a* and brought close to the bottom wall 47 of the case 7. Further revolutions of the base member 15 cause the bottom wall 47 of the case 7 to be sandwiched between the contact portion 59 of the circuit casing 13 and the external fitting portion 93 of the base member 15 (the case contact portion 95). This completes the fixing of the circuit casing 13 and the mount member 5 in the case 7.

Next, as shown in FIG. 6C, the open end 9*a* of the globe 9 is inserted in the space between the case 7 and the mount member 5 and fastened with an adhesive (41) to complete the assembly of the LED light bulb 1.

As described, a structure is employed to assemble the case 7, the circuit casing 13, and the base member 15 in which the bottom wall 47 of the case 7 is sandwiched via the screwing action that brings the circuit casing 13 and the base member 15 close together. This coupling (assembly) may, for instance, be accomplished without requiring adhesive or the like. Efficient and low-cost assembly is thus made possible.

In addition, the angle of slant of the inner face 7*a* of the case 7 at the edge of the large opening side thereof matches that of the outer perimeter 39*a* of the wide-diameter portion 39 of the mount member 5. As a result, the case 7 and the mount member 5 can be brought into secure contact simply by making a slight indentation in the mount member 5 toward the case 7. This enables efficient heat transmission from the mount member 5 to the case 7.

Dimensional variations in the inner diameter of the case 7 at the large opening side, in the outer diameter of the wide-diameter portion 39 of the mount member 5, in the thickness of the mount member 5 and so on (i.e., manufacturing variability) and alterations to the position of the mount member 5 within the case 7 can be tolerated because the lid 63 of the circuit casing 13 is adjustably fixed to the tubular body 61 along the central axis thereof (in the direction of the central axis of the case 7, which is also the insertion direction of the mount member 5 into the case 7).

Furthermore, the circuit casing 13 is attached to the case 7, and the mount member 5 is coupled with the circuit casing 5. As a result, the mount member 5 is fastened to the case 7 and can thus be prevented from falling out therefrom.

Additionally, movement of the LED module 3 is regulated by the recess 27 of the mount member 5 and by the flat tabs 44 of the fixing member 6. Accordingly, not only can the LED module 3 be fastened in a predetermined position through a simple structure using the recess 27 of the mount member 5 and the flat tabs 44 of the fixing member 6, but the LED module 3 can also be brought into secure contact with the contact surface 27*a* by pressing toward the mount member 5. The fixing member 6 can be easily obtained by, for example, punching a plate member.

Also, when the heat from the lit LEDs acts to deform (curve, warp, or otherwise distort) the LED module 3, the pressure on the substrate 17, specifically the resilience of the fixing member 6, the distance from the fixed area of the flat portions 43 to the flat tabs 44, the magnitude of the difference in height between the top surface of the substrate 17 and the fixed area of the flat portions 43 and so on, tolerates such deformation. That is, the pressure is set so as to tolerate such deforming forces.

Accordingly, the LED module 3 is not overly pressed when deformed at light-up time. Thus, fracturing and similar problems rarely occur in the substrate 17 of the LED module 203, even if ceramic or similar material is used therefor.

4. Other

The fixing member 6 pertaining to the above-described Embodiment 1 has a total of two flat tabs 44 at positions corresponding to the two sides sandwiching the light-emitting unit 22 of the LED module 3. However, alternative structures are also permissible, provided that the restoring force against elastic deformations caused by the difference in height between the top surface 5*a* of the mount member 5 and the top surface of the substrate 17 of the LED module 3 in the region spanning from the fastened area of the flat portions 43 through to the flat tabs 44 of the fixing member 6 acts to press the LED module 3 into the contact surface 27*a* of the mount member 5.

(1) Regarding the Flat Tabs

The fixing member 6 pertaining to Embodiment 1 has two flat tabs 44. However, the fixing member may also have more than two flat tabs. A variation with four flat tabs is explained below.

Figure 8A:
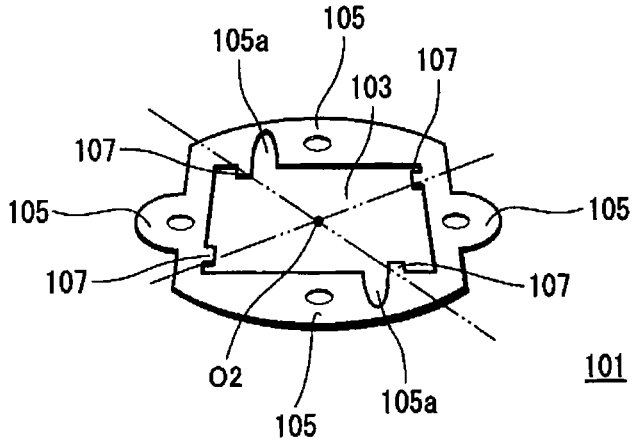
FIGS. 8A, 8B, and 8C illustrate variations of the fixing member.
Figure 8B:
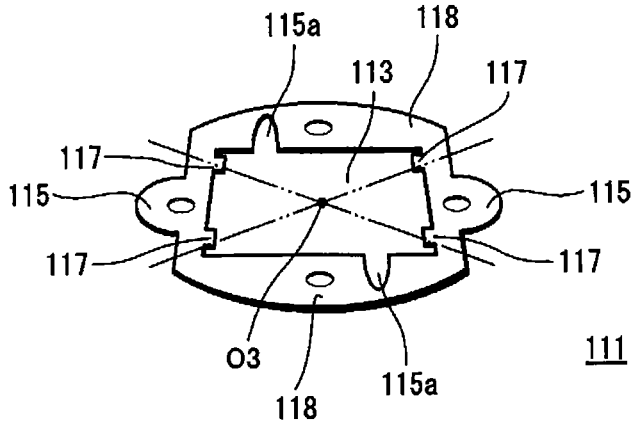
Figure 8C:
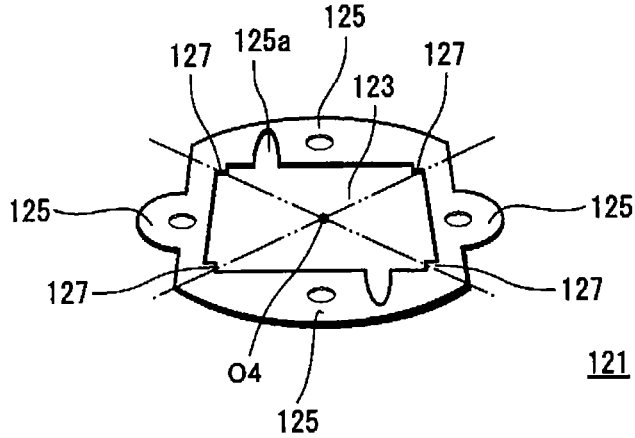

FIGS. 8A, 8B, and 8C are diagrams illustrating variations of the fixing member.

The fixing member 101 shown in FIG. 8A is, much like that of Embodiment 1, formed of a resilient material in a plate-like shape and has a rectangular opening 103 with dimensions corresponding to the shape of the LED module 3 as seen in a plan view.

The fixing member 101 comprises two pairs of flat portions 105 and of flat tabs 107 each projecting from one of the flat portions 105 toward the contact surface 27*a*. The fixing member 101 also has a pair of notches 101*c* to accommodate the lead wires 35 connected to the lighting circuit 11.

The flat tabs 107 are arranged so as to sandwich the centre of the light-emitting unit 22 (the point O2 in FIG. 8A), one being provided on each of the flat portions 105 that include edges forming the sides of the rectangular opening 103. That is, the flat tabs 107 are provided so as to project from the edges of two pairs of mutually-opposing flat portions 105 that form the opening 103. In this example, the pair of flat tabs 107 provided for each pair of edges is arranged so as to exhibit point symmetry about the center O2 of the light-emitting unit 22.

The fixing member 111 shown in FIG. 8B is, much like that of Embodiment 1, formed of a resilient material in a plate-like shape and has a rectangular opening 113 with dimensions corresponding to the shape of the LED module 3 as seen in a plan view.

The fixing member 111 comprises a pair of flat portions 115, four flat tabs 117, and a pair of flat coupling portions 118 that couple the edges of the pair of flat portions 115. The flat tabs 117 are arranged so as to sandwich the centre of the light-emitting unit 22 (the point O3 in FIG. 8B), one pair being provided in opposition on one pair of edges of the flat portions 115 among the edges forming the sides of the rectangular opening 113. That is, the flat tabs 107 are provided so as to project from the edges of one pair of mutually-opposing flat portions 115 that form the opening 113. In this example, the pairs of flat tabs 117 are arranged so as to exhibit point symmetry about the center O3 of the light-emitting unit 22.

The fixing member 121 shown in FIG. 8C is, much like that of Embodiment 1, formed of a resilient material in a plate-like shape and has a rectangular opening 123 with dimensions corresponding to the shape of the LED module 3 as seen in a plan view.

The fixing member 121 comprises two pairs of flat portions 125 and four flat tabs 127. The flat tabs 127 are arranged so as to sandwich the centre of the light-emitting unit 22 (the point O4 in FIG. 8C), one being provided at each of four corners forming the rectangular opening 123. In this example, the pairs of flat tabs 127 are arranged so as to exhibit point symmetry about the center O4 of the light-emitting unit 22.

(2) Regarding Quantity

The fixing member 6 pertaining to Embodiment 1 is made from a single member in a plate-like shape. However, the fixing member may also be, for instance, made from a plurality of such members. A variation using two plate-shaped members is described below.

Figure 9A:
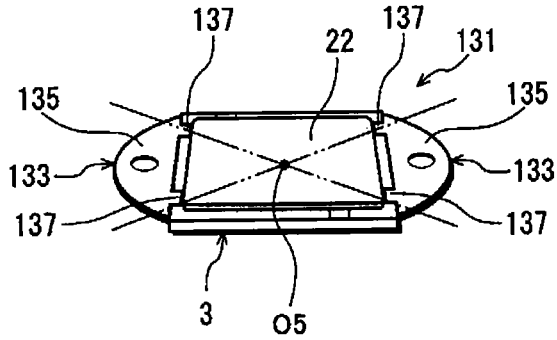
FIGS. 9A and 9B illustrate variations of the fixing member.
Figure 9B:
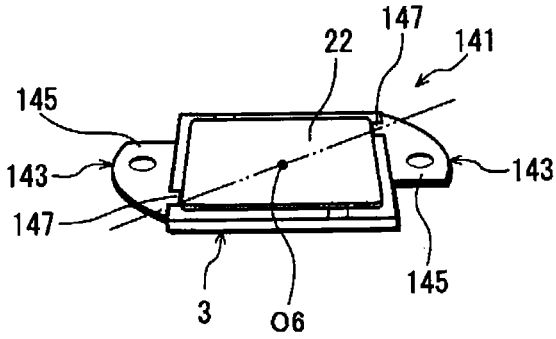

FIGS. 9A and 9B are diagrams illustrating variations of the fixing member.

The LED module 3 is also drawn in FIGS. 9A and 9B so that the positional relationships therewith can be understood.

As shown in FIG. 9A, fixing member 131 is, much like that of Embodiment 1, made a resilient material in two plate-like members 133. The two plate-like members 133 are identically configured. As such, the following explanations concern only one plate-like member 133.

The plate-like member 133 comprises flat portions 135 fastenable to the top surface (5*a*) of the mount member (5) and two flat tabs 137 reaching from the flat portions 135 toward the contact surface (27*a*).

The flat portions 135 are disposed along two opposing edges of the LED module 3, which is rectangular as seen in a plan view. The plate-like member 133 is fastened to the mount member (5) by screws at positions (the fastened areas) on the flat portions 135 roughly corresponding to the centre of each of the edges. The flat tabs 137 are provided at both sides thereof.

The flat tabs 137 of the plate-like members 133 are provided at opposite positions on both sides of the center of the light-emitting unit 22 (point O5 in FIG. 9). In this example, the pairs of flat tabs 137 are arranged so as to exhibit point symmetry about the center O5 of the light-emitting unit 22.

As shown in FIG. 9B, fixing member 141 is, much like that of Embodiment 1, made a resilient material in two plate-like members 143. The two plate-like members 143 are identically configured. As such, the following explanations concern only one plate-like member 143.

The plate-like member 143 comprises flat portions 145 fastenable onto the top surface (5*a*) of the mount member (5) and one flat tab 147 reaching from each of the flat portions 145 toward the contact surface (27*a*). The flat portions 145 of the two plate-like members 143 are fastened onto the mount member (5) by screws along two opposing edges of the LED module 3, which is a rectangle as seen in a plan view. The flat tabs 137 project along the directions of the two remaining edges.

The pair of flat tabs 147 of the plate-like members 143 are arranged so as to exhibit point symmetry about the center O6 of the light-emitting unit 22.

(3) Pressing Portion

The fixing member 6 pertaining to Embodiment 1, as well as the fixing members 101, 111, 121, 133, and 143 shown in FIGS. 8A, 8B, 8C, 9A, and 9D, press the LED module 3 into the mount member 5 with the flat tabs (i.e., the flat tabs 44 or other) which project parallel to the flat portions (i.e., the flat portions 43 or other) before the mounting of the fixing member 6 onto the mount member 5. However, other components may also fulfill this role.

In the present invention, as long as a portion is able to press the LED module 3 into the mount member 5 through the effect of forces applied by the pressing portion when the fixing member 6 is fastened to the mount member 5 with a constant orientation, the structure need not involve portions such as the flat tabs 44 of Embodiment 1, which reach toward the LED module 3 so as to apply pressure thereto. Other structures may also be used.

Figure 10A:
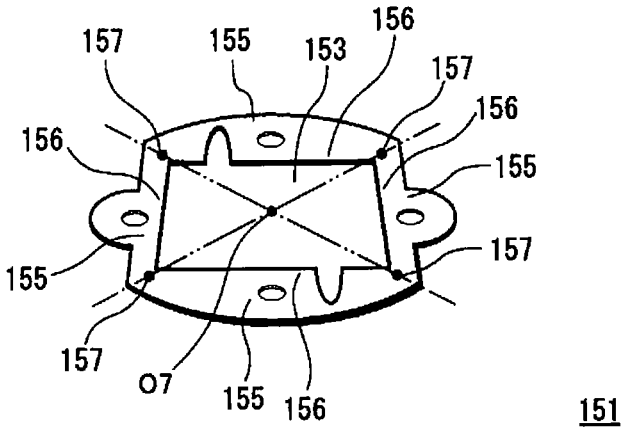
FIGS. 10A and 10B illustrate variations of the fixing member.
Figure 10B:
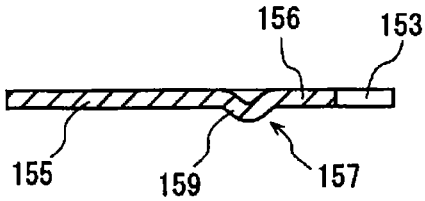

FIG. 10A is a perspective view of a fixing member variation, and FIG. 10B is a cross-section thereof taken so as to include the pressing portion.

The fixing member 151 shown in FIG. 10A is, much like that of Embodiment 1, formed of a resilient material in a plate-like shape and has a rectangular opening 153 with dimensions corresponding to the shape of the LED module 3, which is rectangular as seen in a plan view.

The fixing member 151 comprises two pairs of flat portions 155, four extensions 156 reaching from each of the flat portions 155 toward the light-emitting unit 22 of the LED module 3, and four indentations 157.

When the fixing member 151 is placed on the LED module 3, the indentations 157 are brought into contact with the substrate 17 of the LED module 3. Also, the opening 153 thereof is smaller than the opening 42 of the fixing member 6 pertaining to Embodiment 1.

The indentations 157 are arranged so as to sandwich the center of the light-emitting unit 22 (point O7 in FIG. 10A) along each of two diagonals drawn through the corners of the square opening 153. In this example, the indentations 157 are arranged so as to exhibit point symmetry about the center O7 of the light-emitting unit 22.

As shown in FIG. 10B, the indentations 157 are formed in the plate-like member that makes up the fixing member 151 by locally indenting the top surface to form bumps 159 at the bottom surface thereof. The bumps 159 may also be formed by attaching a component other than the plate-like member at predetermined positions thereof.

Embodiment 2

In the above-described Embodiment 1, solder is used to connect the lead wires 35 connecting the lighting circuit 11 to the terminal 25*b* of the LED module 3. However, the ends of the lead wires may also be electrically connected to the terminals of the LED module by pressing a connection terminal member thereto.

The following describes Embodiment 2, which makes use of a connection terminal member.

1. Configuration

Figure 11:
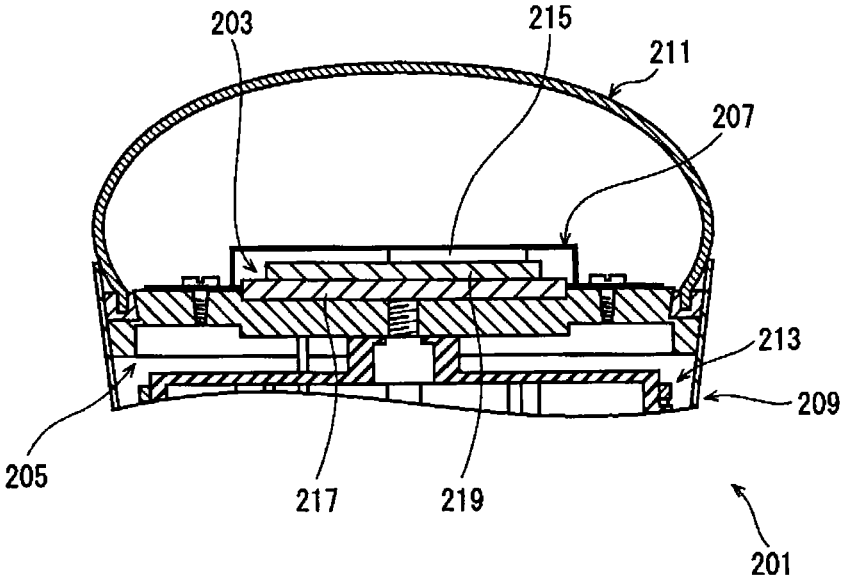
FIG. 11 shows a magnified view of the periphery of the LED module in a cross-section of the LED light bulb pertaining to Embodiment 2.
Figure 12:
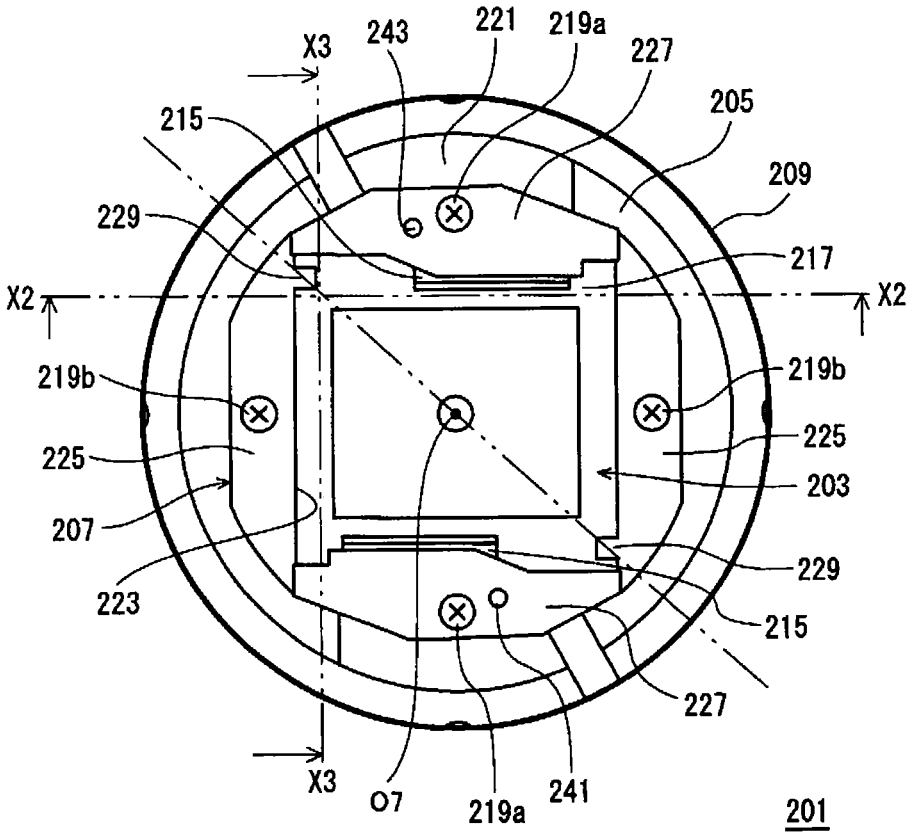
FIG. 12 shows a top-down view of the LED light bulb without a globe.

FIG. 11 shows an expanded view of the LED module in a longitudinal cross-section of the LED light bulb pertaining to Embodiment 2. FIG. 12 shows the LED light bulb as seen from above with the globe removed.

Much like that of Embodiment 1, the LED light bulb 201 pertaining to Embodiment 2 comprises an LED module 203, a mount member 205 on which the LED module is mounted, a fixing member 207 for fixing the LED module 203 on the mount member 205, a case 209 that has the mount member 5 at one end thereof, a globe 211 that covers the LED module 203, a lighting circuit (not diagrammed) that lights up the LEDs (causes the LEDs to emit light), a circuit casing 213 that contains the lighting circuit therein and that is arranged within the case 209, and a base member (not diagrammed) arranged at another end of the case 209. The lighting circuit and the LED module 203 are electrically connected by a connection terminal member 215.

Much like that of Embodiment 1, the LED module 203 is made up of a substrate 217 and a light-emitting unit 219. The substrate 217 is shaped as a rectangle when seen in a plan view, and has a pair of opposing terminals 217*a* located between one of the peripheral edges thereof and the light-emitting unit 219 (see FIG. 13). Coated portions 218 are formed on the substrate 217 for protection against damage caused by the fixing member 207 being pressed thereinto. The coated portions 218 are, for example, formed when the wiring pattern, which is a component of the substrate 217, is made, using the same material thereas. The coated portions 218 may also be formed of a material different than that of the wiring pattern, at a different processing stage.

Figure 13:
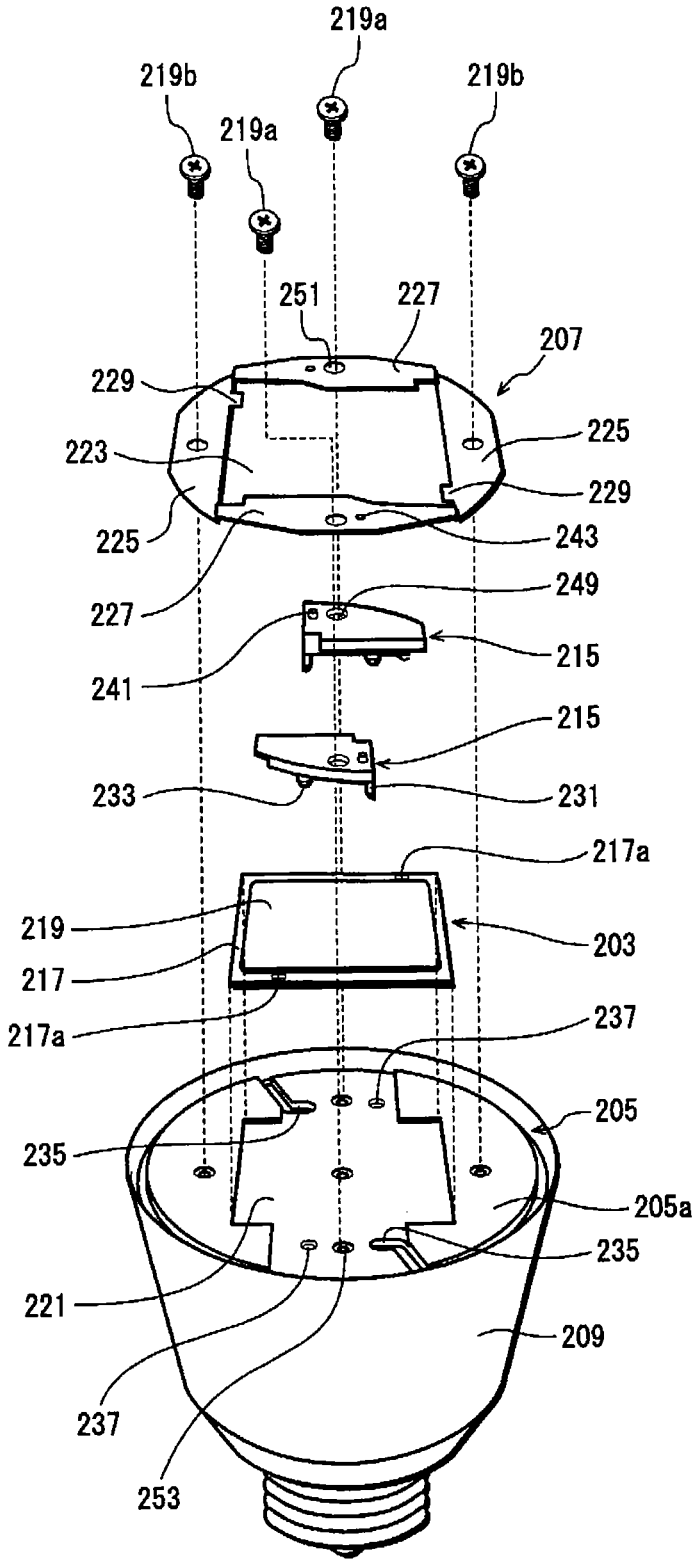
FIG. 13 illustrates mounting the LED module on the mount member.
Figure 14:
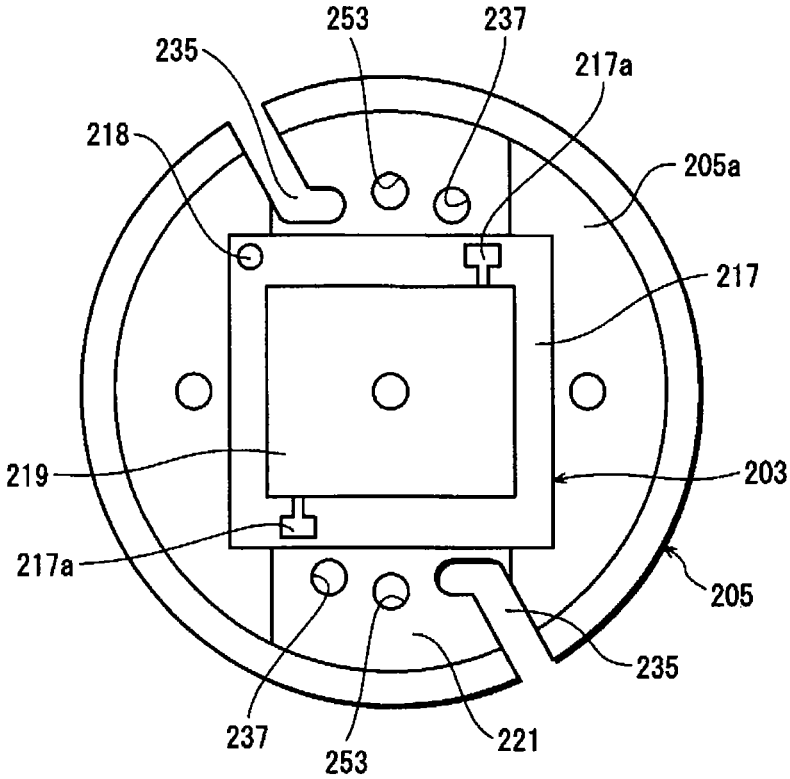
FIG. 14 shows a top-down view of the mount member with the LED module mounted thereon.
Figure 15:
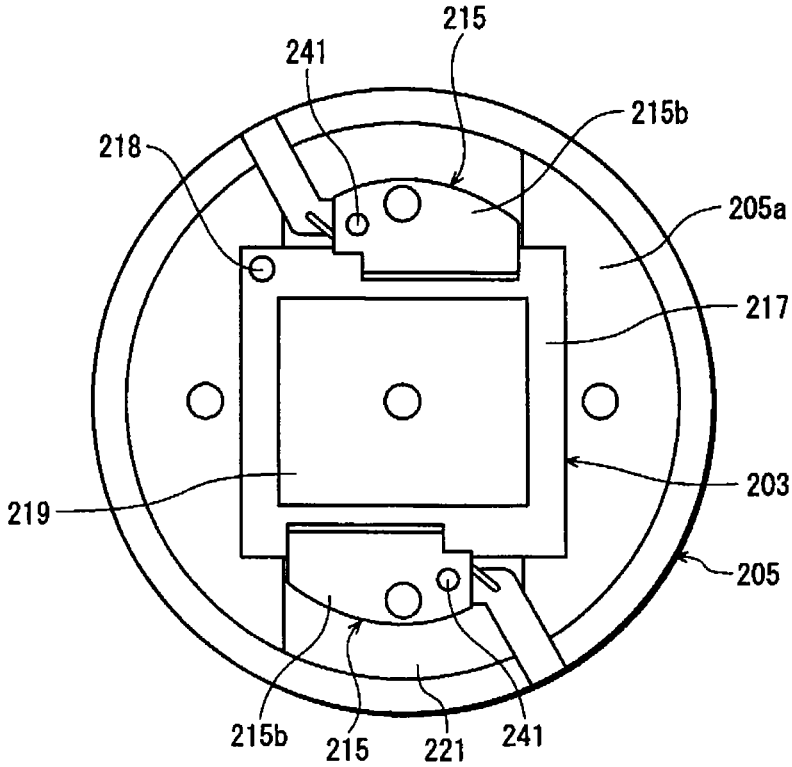
FIG. 15 shows a top-down view of the mount member with the LED module and a connection terminal member mounted thereon.

FIG. 13 is a diagram illustrating the mounting of the LED module onto the mount member. FIG. 14 is a top-down view of the LED module mounted on the mount member. FIG. 15 is a top-down view of the LED module and the connection terminal member 215 mounted on the mount member.

As shown in FIG. 13, the mount member 205 has a groove 221 laterally traversing the midsection thereof. The LED module 203 can be fit into the central portion of the groove 221. The bottom of the central portion of the groove 221 serves as a contact surface 221*a* that is in contact with the bottom surface of the LED module 203 (the bottom surface of the substrate 217, to be precise).

Much like in Embodiment 1, the height of the top (upper) surface 205*a* of the mount member 205 of Embodiment 2 is lower than the height of the substrate 217 of the LED module 203, with reference to the above-described contact surface 221*a*. Specifically, when the LED module 203 is fit into the central portion of the groove 221, the top surface of the substrate 217 thereof comes to be higher than the top surface 205*a* of the mount member 205.

As shown in FIG. 13, and much like that of Embodiment 1, the fixing member 207 is made from a single plate-like member formed of a resilient material, and has a central rectangular opening 223 corresponding to the dimensions of the LED module 3 as seen in a plan view. The outer portions of the opening 223 consist of a pair of low level portions 225 fastened to the top surface of the mount member 205 so as to oppose one another, and of a pair of high level portions 227 coupling the low level portions 225 at each end thereof and positioned so as to oppose one another while being higher than the low level portions 225. A pair of flat tabs 229 reach from the low level portions 225 toward the contact surface 221*a*.

In other words, the two low level portions 225 oppose each other and the two high level portions 227 also oppose each other, so as to correspond to the two pairs of edges of the LED module 203, which is rectangular when seen in a plan view. The flat tabs 229 are provided on the low level portions 225.

The high level portions 227 are provided along the edges nearest the terminals 217*a* of the LED module 203. As described above, the high level portions 227 are positioned so as to be higher than the low level portions 225. As shown in FIGS. 11 through 13, the connection terminal members 215 are arranged in the space between the mount member 205 and the high level portions 207 when the fixing member 207 is fastened to the mount member 205

The flat tabs 229 are arranged so as to sandwich the centre of the light-emitting unit 219 (point O7 in FIG. 12) on each of two opposing sides so as to exhibit point symmetry about the center O7 of the light-emitting unit 219.

Figure 16:
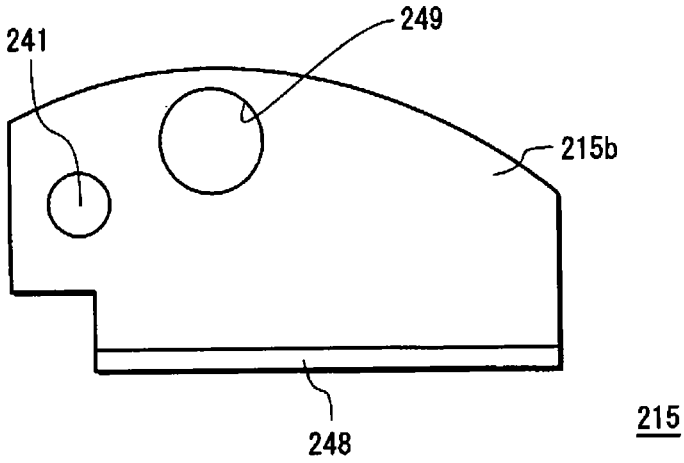
FIG. 16 shows a plan view of the connection terminal member.
Figure 17:
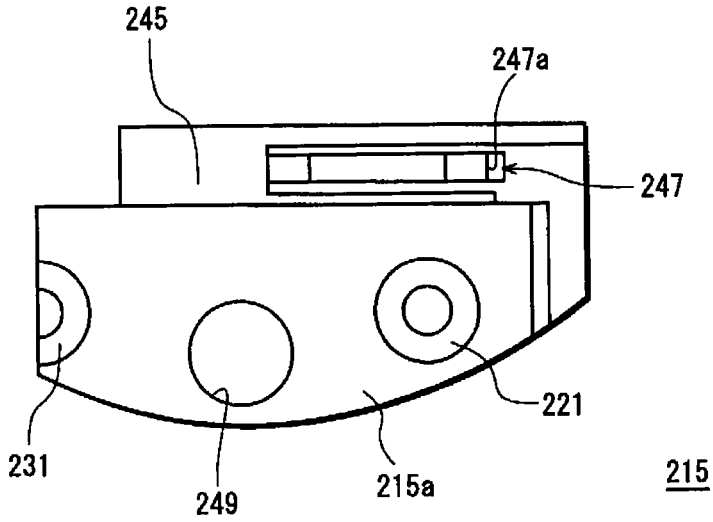
FIG. 17 shows a plan view of the bottom surface of the connection terminal member.
Figure 18:
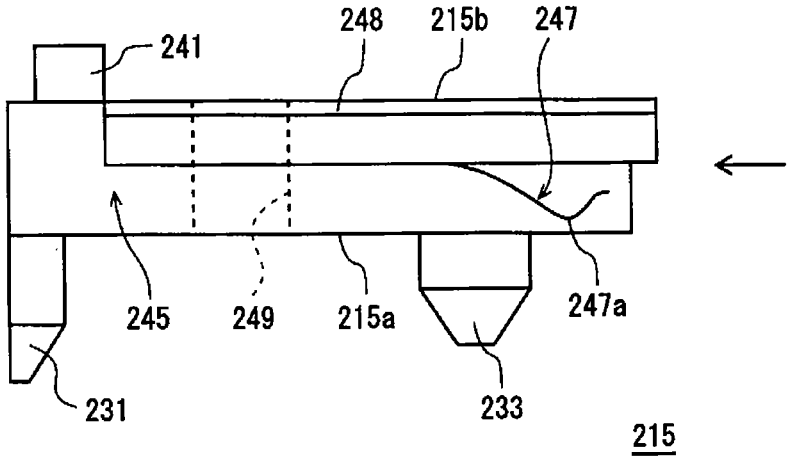
FIG. 18 shows a frontal view of the connection terminal member.
Figure 19:
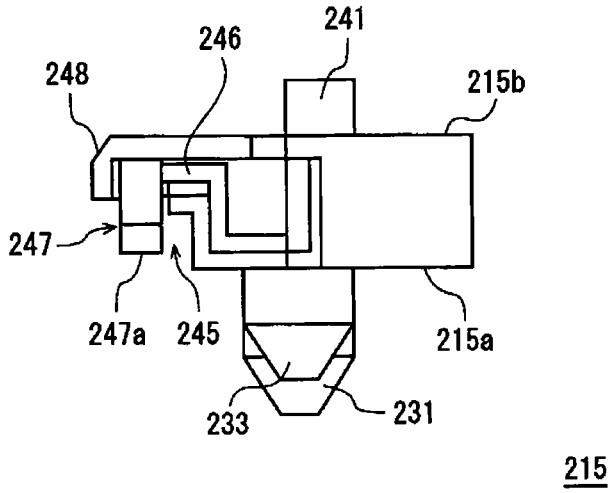
FIG. 19 shows a lateral view of the connection terminal member from the direction of the arrow in FIG. 17.

FIGS. 16 through 19 are diagrams showing the connection terminal member. FIG. 16 is a plan view, FIG. 17 is a bottom view, FIG. 18 is a front view, and FIG. 18 is a side view from the direction indicated by the arrow in FIG. 18.

As shown in FIGS. 15 and 16, the connection terminal member 215 is long and thin in a direction matching one side of the substrate 217 of the LED module 203. Also, as shown in FIG. 18, the bottom surface 215*a* and the top surface 215*b* thereof are nearly parallel.

Figure 20:
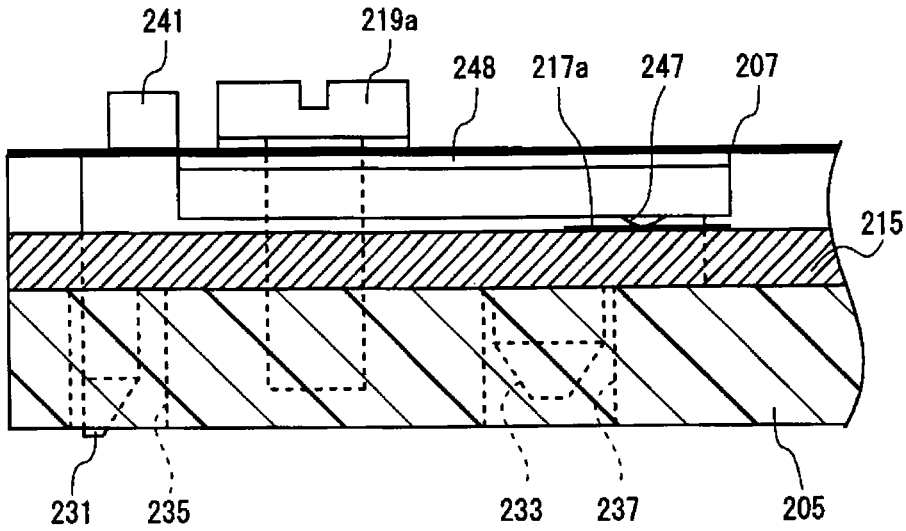
FIG. 20 shows a magnified view of a cross-sectional diagram taken along the line X2-X2 of FIG. 12 as viewed from the direction indicated by the arrows.

As shown in FIGS. 17 and 18, the bottom surface 215*a* has two downwardly-protruding portions 231 and 233 protruding downward therefrom. As shown in FIGS. 13, 14, and 20, the downwardly-protruding portions 231 and 233 are configured for respective insertion into positioning holes (more accurately termed grooves through which pass the lead wires connected to the lighting circuit) 235 and 237 in the mount member 205. Thus, movement of the connection terminal member 215 relative to the mount member 205 along the contact surface 221*a* thereof is regulated.

As shown in FIGS. 16 and 18, the top surface 215*b* has one upwardly-protruding portion 241 protruding upward therefrom. As shown in FIGS. 12 and 13, the upwardly-protruding portions 241 are configured for insertion into positioning hole 243 in the fixing member 207. Accordingly, not only can the movement of the fixing member 207 relative to the mount member 205 along the high level portion 227 be constrained, but the fixing member 207 can be positioned relative to the mount member 205 via the connection terminal member 215.

The connection terminal member 215 is located opposite a corner of the substrate 217, has a stepped portion 245 that is slightly thicker than the substrate 217, and comprises a flat spring 247 that projects down (toward the mount member 205) from the stepped portion 245 and that is electrically conductive. The flat spring 247 has a tip 247*a* that pushes the terminal 217*a* of the LED module 203 against the contact surface 221 when the connection terminal member 215 is fastened by the fixing member 207.

The flat spring 247 is connected to a metallic strip 246 within the connection terminal member 215. The metallic strip 246 is connected to an end of one of the lead wires (35), which is in turn connected to the lighting circuit (11), and is inserted into the connection terminal member 215 in the direction of the arrow shown in FIG. 18.

The restoring force (spring constant) of the flat spring 247 allows deformations when the heat produced by the lit LEDs acts to deform (warp) the LED module 203. In other words, the restoring force is set so as to tolerate forces causing such deformations.

Accordingly, the LED module 203 is not overly pressed when deformed at light-up time. Thus, fracturing and similar problems do not occur in the substrate 217 of the LED module 203, even if ceramic or similar material is used therefor.

The connection terminal member 215 has a through-hole 249 formed therein so as to pass from the top surface 215*b* through the bottom surface 215*a*. Also, a through-hole 251 in the fixing member 207 and a screw hole 253 in the mount member 205 are respectively formed so as to correspond to the through-hole 249.

Furthermore, the connection terminal member 215 may be made using, for instance, an insulating material (including materials to which an insulating process has been applied). The portion of the connection terminal member 215 that is arranged higher than the light-emitting unit 219 has an inclined portion 248 with which to reflect light. The inclined portion may also be configured so as to span across the lateral face opposite the light-emitting unit 219.

The connection terminal member 215 may be made using, for instance, an insulating material such as a synthetic resin or inorganic material; for example, silicone that contains silica. In addition, the top surface of the inclined portion 248 is ideally made reflective, for instance by forming the connection terminal member 215 from white resin or metal (an insulating process having been applied thereto), or by forming a reflective membrane over the surface.

Figure 21:
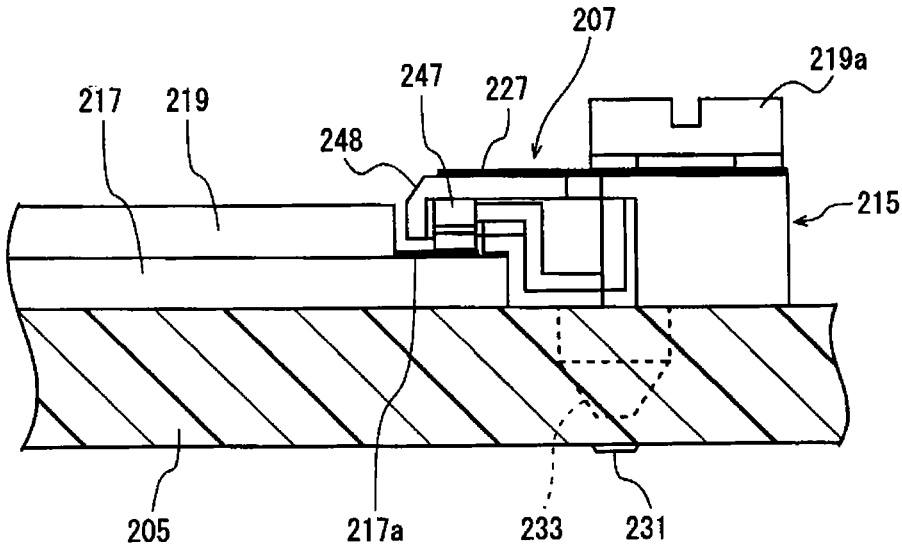
FIG. 21 shows a magnified view of a cross-sectional diagram taken along the line X3-X3 of FIG. 12 as viewed from the direction indicated by the arrows.

FIG. 20 shows an expanded view of a cross-section taken along the line X2-X2 in FIG. 12 from the direction indicated by the arrows pointing thereto. FIG. 21 shows an expanded view of a cross-section taken along the line X3-X3 in FIG. 12 from the direction indicated by the arrows pointing thereto.

The connection terminal member 215 is fixed onto the LED module 203 and the mount member 205 as follows. First, the LED module 203 is mounted on the mount member 205 at a predetermined position in the groove 221 thereof. Next, the upwardly-protruding portion 241 of the connection terminal member 215 is fixed into the positioning hole 243 of the fixing member 207 as the downwardly-protruding portions 231 and 233 of the connection terminal member 215 are inserted into the positioning holes 235 and 237 of the mount member 205. Each of the screw members 219*a* is threaded through one through-hole 251 in the fixing member 207 and one through-hole 249 in the connection terminal member 215, then fastened to one of the screw holes 253 in the mount member 205 while the low level portions 225 of the fixing member 207 are fastened to the mount member 205 with the screw members 219*b*.

The fixing member 207 pertaining to Embodiment 2 uses a component unlike the flat tabs 44 of the fixing member 6 pertaining to Embodiment 1, namely the connection terminal member 215, to press the substrate 217 toward the mount member 205. Thus, the pressing force applied thereby can be made stronger than that applied by the fixing member 6 pertaining to Embodiment 1.

2. Other

The fixing member 207 pertaining to the above-described Embodiment 2 has a pair of low level portions 225 and a pair of high level portions 227 such that, as shown in FIG. 21, the high level portions 227 come to be higher than the upper surface of the light-emitting unit 219 of the LED module 203.

More precisely, when the LED module 203, fixed on the mount member 205 by the fixing member 207, is viewed laterally (as in FIG. 21), gaps appear between the top surface of the substrate 217 and the high level portions 227 as well as between the top surface of the mount member 205 and the high level portions 227.

For this reason, the light propagating laterally from the light-emitting unit 219, particularly toward the gaps between the top surface of the substrate 217 and the high level portions 227 and toward the gaps between the top surface of the mount member 205 and the high level portions 227, does not radiate out of the LED light bulb 201. In other words, the light radiated by the LED module 203 is not used effectively.

Figure 22A:
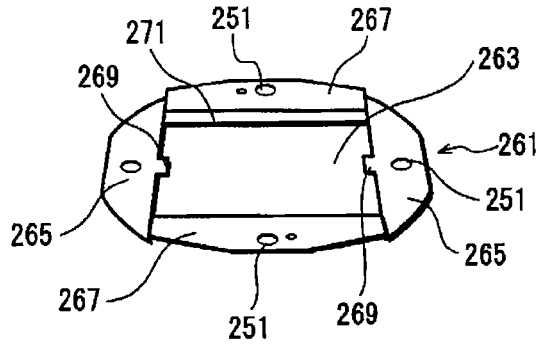
FIGS. 22A, 22B, and 22C illustrate variations of the fixing member pertaining to Embodiment 2.
Figure 22B:
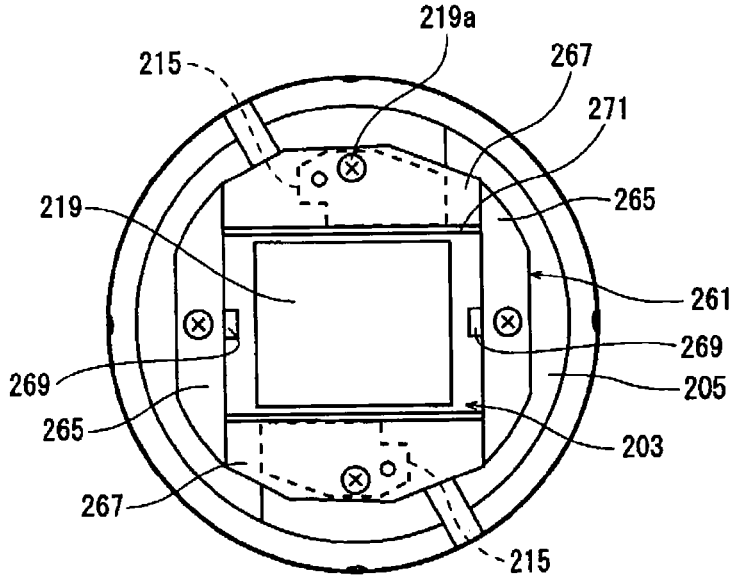
Figure 22C:
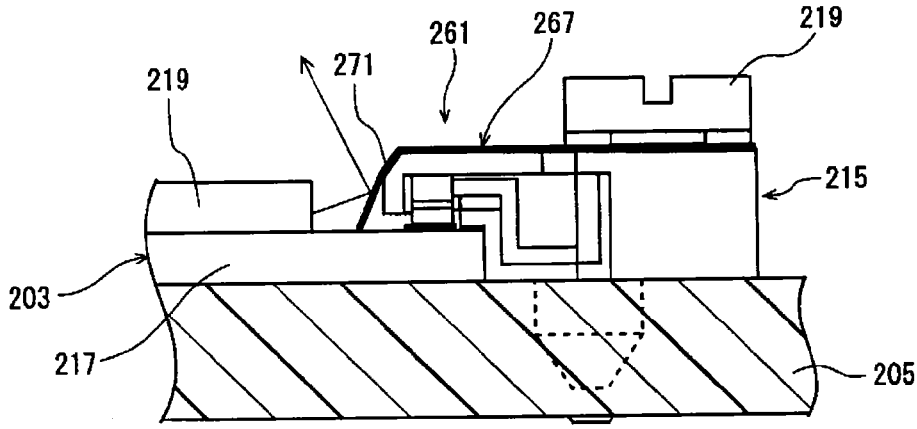

FIGS. 22A, 22B, and 22C illustrate a variation of the fixing member pertaining to Embodiment 2. FIG. 22A shows a perspective view of the fixing member, FIG. 22B shows the LED light bulb as seen from above with the globe removed, and FIG. 22C is a cross-section diagram of the fixed fixing member, taken through an area that includes a high level portion.

As shown in FIG. 22A, and much like that of Embodiment 2, the fixing member 261 is made from a single plate-like member formed of a resilient material and has a central rectangular opening 263 corresponding to the dimensions of the light-emitting unit 219 of the LED module 203 as seen in a plan view. The outer portions of the opening 263 consist of a pair of low level portions 265 and of a pair of high level portions 267. A pair of flat tabs 269 project from the low level portions 265 toward the contact surface 221*a* of the mount member 205.

The low level portions 265 and the high level portions 267 have through-holes 251 formed therein to allow screws to pass through and fasten the fixing member 261 to the mount member 205.

As described above, the high level portions 267 are positioned so as to be higher than the low level portions 225. As shown in FIG. 22C, the connection terminal members 215 are arranged in the space between the mount member 205 and the high level portions 267 when the fixing member 261 is fastened to the mount member 205.

As shown in FIG. 22C, the edges of the high level portions 267 near the light-emitting unit 219 of the LED module 203 form an incline 271 angled so as to come between the lateral face of the light-emitting unit 219 and the connection terminal member 215. More precisely, the leading edge of the high level portions 267 near the light-emitting unit 219 of the LED module 203 projects out (corresponding to the projecting portion of the present invention) to the vicinity of the substrate 217 of the LED module 203.

The surface of the incline 271 (the surface facing the light-emitting unit 219) is reflective. Thus, as indicated by the arrow in FIG. 22C, light output laterally from the light-emitting unit 219 is reflected by the incline 271 toward the globe.

Accordingly, the light output laterally by the light-emitting unit 219 is made less likely to fall into the gaps between the top surface of the substrate 217 and the high level portions 227 or the gaps between the top surface of the mount member 205 and the high level portions 227. The light radiated by the LED module 203 can thus be used more effectively.

[Variations]

The present invention has been described above according to the Embodiments. However, the present invention is, naturally, not limited to the specific example presented therein. The following variations are also possible.

1. Fixing Member (Pressing Member)

(1) Shape

In the above-described Embodiments, the LED (light-emitting) module is in the shape of a rectangle when seen in a plan view. However, other shapes are also possible. Examples include round, oval, elliptical, and other such shapes having a predetermined curvature, as well as triangular, hexagonal, and other polygonal shapes, and even shapes combining arcs with polygons. However, the top surface of the substrate must have an area that comes into contact with the flat tabs of the fixing member.

(2) Pressing Position

In the above-described Embodiments, the LED (light-emitting) module is pressed by the fixing member at positions on the substrate near a virtual line joining opposite corners thereof. However, if the substrate is rectangular and is pressed at four or more positions, the pressing positions may be on or near a virtual line joining the midpoints of opposing edges of the substrate.

However, the LED module (substrate) is deformed by the heat produced when the LED light bulb is lit up. Thus, taking a regulatory perspective, pressing the substrate at positions removed from the center of the light-emitting unit can be seen to effectively regulate LED module deformations. If the substrate is rectangular as seen in a plan view, then pressing points on or near a virtual line joining opposing corners thereof remains preferable.

Should deformations in the lit LED module be excessively regulated, the stresses remaining within the LED module may produce fractures in the substrate. Thus, adjusting the pressing force according to the material used in the substrate is preferable.

Also, the light-up time heat often causes deformation (warping) in the LED module to such a degree that while the central portion of the LED module is in contact with the mount member, the rim thereof becomes separated. Incidentally, the lit LED module is hottest at the central portion of the light-emitting unit. As such, in order to efficiently transmit the light-up time heat to the mount member, the portion of the bottom surface of the substrate corresponding to the center of the light-emitting unit 22 should preferably be in contact with the mount member during illumination. Accordingly, opposing pressed positions of the substrate should preferably be nearly equidistant from the centre of the light-emitting unit.

Figure 23A:
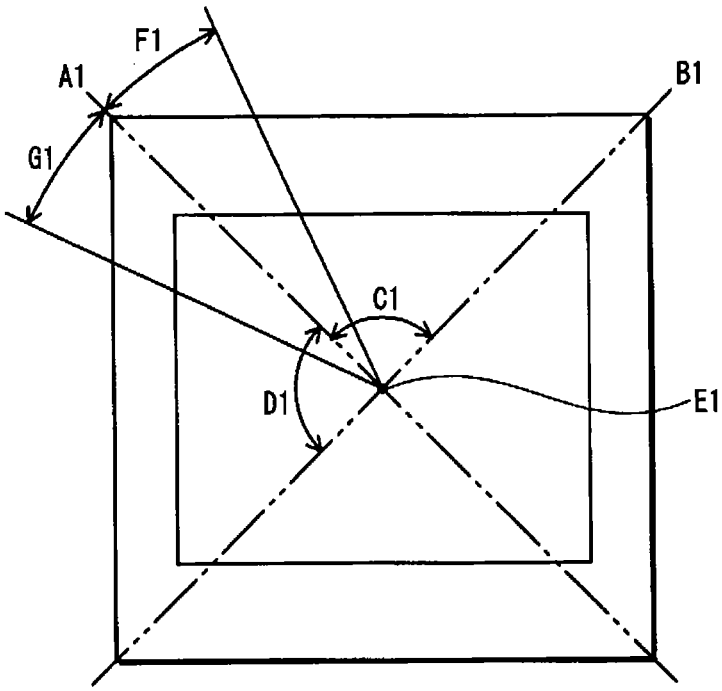
FIGS. 23A and 23B are diagrams illustrating ranges within which the pressing positions on a rectangular substrate may fall, FIG. 23A showing positions near a virtual line joining opposing corners
Figure 23B:
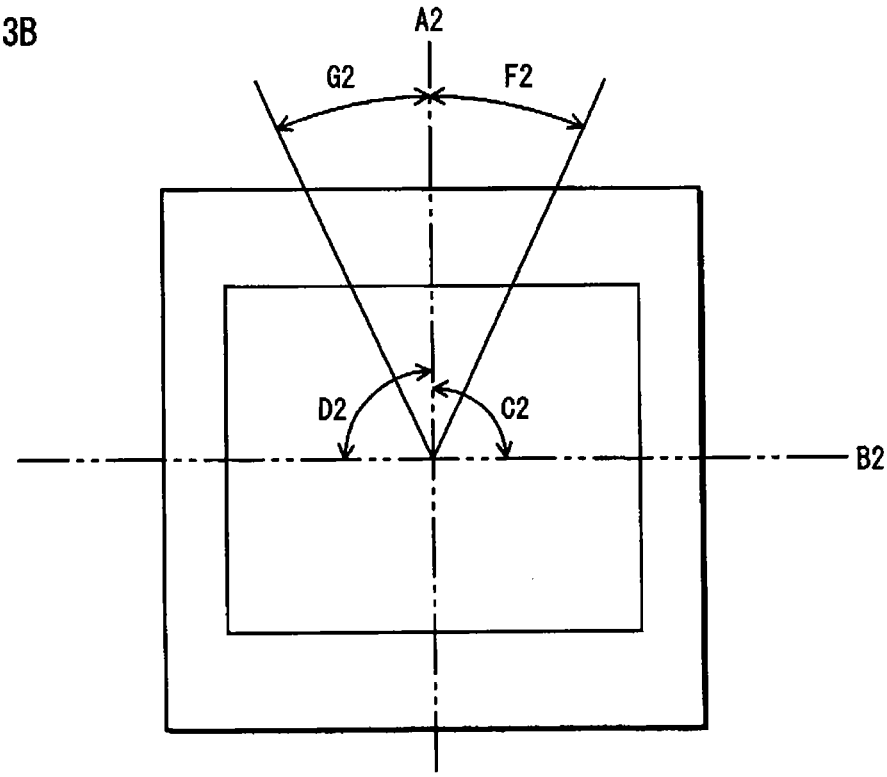

FIGS. 23A and 23B are diagrams illustrating the range within which the pressing positions on a rectangular substrate may fall. FIG. 23A shows positions near a virtual line joining the opposing corners, and FIG. 23B shows positions near a virtual line joining the midpoints.

Possible pressing positions near virtual lines A1 and B1, which join opposing corners of a rectangular substrate, are shown in FIG. 23A. Let the angles between the virtual lines A1 and B1 be denoted C1 and D1. Then, the range of possible positions near the virtual line A1 is, for example, the area offset by as much as the angles F1 and G1 from the center E1 toward B1, with respect to the virtual line A1. Here, the angles F1 and G1 are one-third the angles C1 and D1. By defining the above-described range with the angles F1 and G1, the bottom surface of the substrate of the LED module at the central region of the light-emitting unit remains unseparated from the contact surface despite warping of the LED module during light-up. Thus, advantageous thermo-conduction can be obtained.

Next, possible pressing positions near virtual lines A2 and B2, which join the midpoints, are shown in FIG. 23B. Let the angles between the virtual lines A2 and B2 be denoted C2 and D2. Then, the range of possible positions near the virtual line A2 is, for example, the area offset by as much as the angles F2 and G2 from the center E2 toward B2, with respect to the virtual line A2. Here, the angles F2 and G2 are one-third the angles C2 and D2.

The pressing positions explained using FIGS. 23A and B are given for a substrate that is rectangular as seen in a plan view. However, the shape of the substrate may also be as described in variation (1), above, as long as the range near the virtual lines is defined by the same angles. The virtual lines are not limited to joining opposing corners or midpoints. Any straight virtual line intersecting the center of the light-emitting unit may be used.

(3) Quantity of Pressing Positions

Embodiment 1 has a total of two pressing positions, and Embodiment 2 has a total of four pressing positions through the connection terminal member. However, the quantity of pressing positions may vary as long as the positions are in opposition and are two or more in total. If a plurality of pressing positions are used, then when the angle formed by two neighboring pressing positions with respect to the centre of the light-emitting unit is 45° or less, each pressing position need not necessarily be on or near a virtual line passing through the centre of the light-emitting unit.

(4) Connection Terminal Member

In Embodiment 2, a connection terminal member is used to press the rectangular LED module at a total of four positions. However, if the shape of the LED module, the quantity or location of the pressing positions, and the like vary, then the connection terminal member is not limited to the example of Embodiment 2. The following variations thereof are also possible.

Figure 24A:
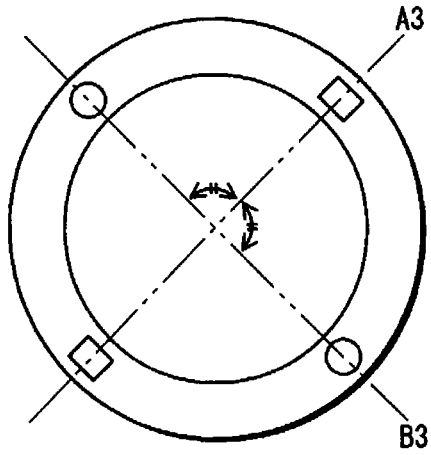
FIGS. 24A, 24B, and 24C illustrate variations of the connection terminal member, FIG. 24A showing a variation in shape, FIG. 24B showing a variation in pressing position quantity, and FIG. 24C showing a variation in pressing position location.
Figure 24B:
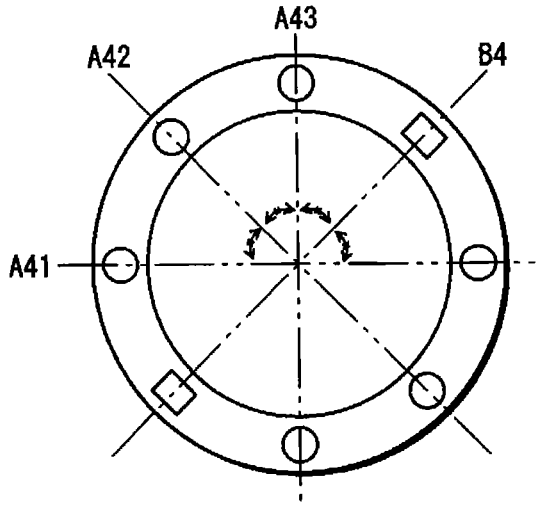
Figure 24C:
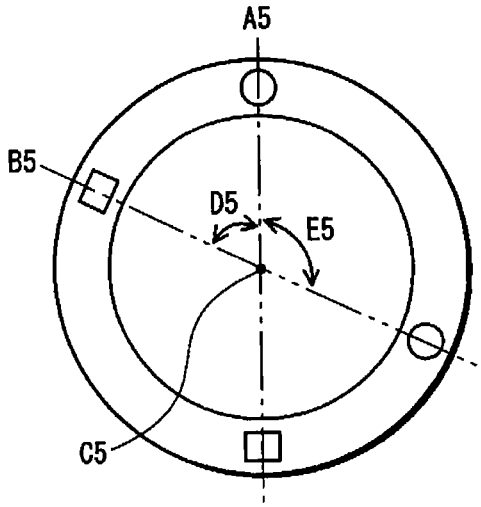

Variations of the connection terminal member are illustrated using FIGS. 24A, 24B, and 24C. FIG. 24A shows a variation in shape, FIG. 24B shows a variation in quantity of pressing positions, and FIG. 24C shows a variation in the location of the pressing positions.

The LED module in the variation shown in FIG. 24A is circular when seen in a plan view, and the light-emitting unit thereof is also circular. A total of four pressing positions are used therein. The areas pressed by the flat tabs of the fixing member are denoted with small circles, and the areas pressed by the connection terminal member are denoted by small squares.

In this example, a virtual line A3 joins the two pressing positions pressed by the flat tabs, while a virtual line B3 joins the two pressing positions pressed by the connection terminal member (that is, the virtual lines A3 and B3 are orthogonal).

The LED module in the variation shown in FIG. 24B is circular when seen in a plan view, and the light-emitting unit thereof is also circular. A total of eight pressing positions are shown. The areas pressed by the flat tabs of the fixing member are denoted with small circles, and the areas pressed by the connection terminal member are denoted by small squares.

In this example, three virtual lines A41, A42, and A43 join pairs of pressing positions pressed by flat tabs and a virtual line B4 joins the two pressing positions pressed by the connection terminal member such that all angles between virtual lines are equal. In other words, the LED module is pressed at equal intervals in the circumferential direction thereof.

The LED module in the variation shown in FIG. 24C is, much like that shown in the above-described FIG. 24A, circular when seen in a plan view, and the light-emitting unit thereof is also circular, having a total of four pressing positions. To be precise, the top surface of the substrate of the LED module is pressed into the contact surface of the mount member by two flat tabs of the fixing member and by two connection terminal members.

The areas pressed by the flat tabs of the fixing member are denoted with small circles, and the areas pressed by the connection terminal member are denoted by small squares.

The above-described Embodiment 2 also has a total of four pressing positions. However, in Embodiment 2, the two flat tabs 229 and the two connection terminal members 215 are placed along a virtual line that passes through the center of the light-emitting unit 219. In the present variation, one of the flat tabs and one of the connection terminal members are placed along a virtual line A5 that passes through the centre C5 of the light-emitting unit, whereas the other flat tab and the other connection terminal member are placed along a virtual line B5. In the present variation, the angles D5 and E5 between the virtual lines A5 and B5 are unequal.

Additionally, in the Embodiments and variations thereon, the LED module is pressed at opposing positions that are on or fall into a range near virtual lines passing through the center of the light-emitting unit and that sandwich the center therebetween. However, the position of the LED module in contact with the mount member may also be inverted (such that the contact surface of the LED module with the mount member is the top surface of the LED member) as long as the LED module maintains contact with the mount member. The pressing positions need not be on or near the above-described virtual lines as long as the heat of illumination can be transmitted from the LED module to the mount member.

(5) Fastening Method

In the above-described Embodiments, the fixing member is fastened onto the mount member by using screws. However, other fastening methods are also possible. Examples of other fastening methods include welding and riveting.

Figure 25A:
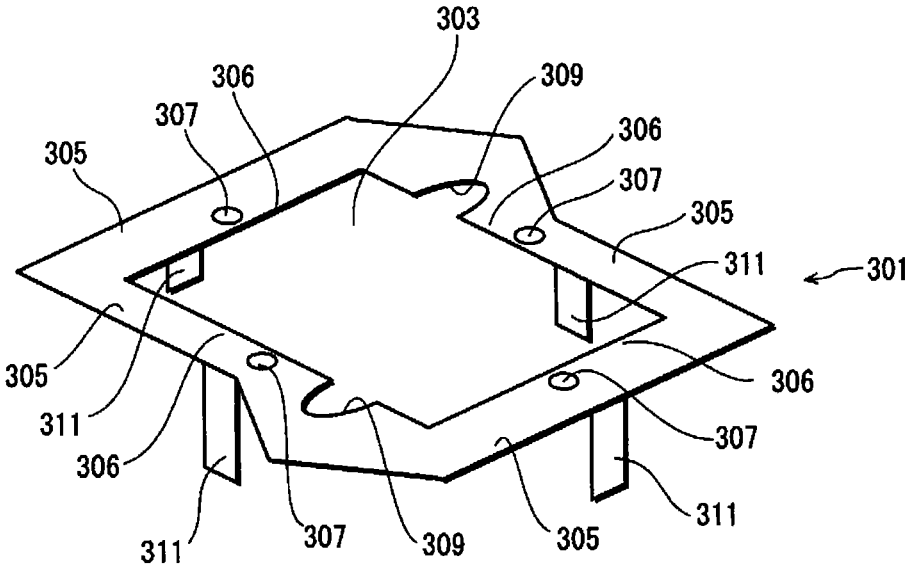
FIGS. 25A and 25B illustrate an alternative method for fastening the fixing member to the mount member, FIG. 25A showing a perspective view of the fixing member and FIG. 25B showing a cross-section thereof as fastened to the mount member.
Figure 25B:
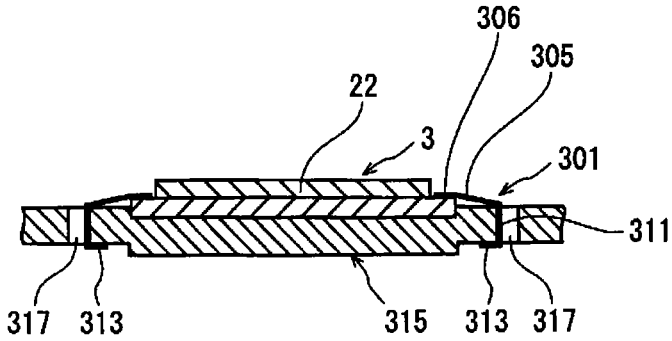

FIGS. 25A and 25B illustrate an alternative method for fastening the fixing member to the mount member. FIG. 25A is a perspective view of a fixing member variation, and FIG. 25B is a cross-section thereof.

The fixing member 301 is formed of a resilient material in a plate-like shape and has a rectangular opening 303 with dimensions corresponding to the shape of the light-emitting unit 22 of the LED module 3, which is rectangular as seen in a plan view.

The fixing member 301 comprises two pairs of flat portions 305, four extensions 306 extending from the flat portions 305, and four indentations 307 formed on the extensions 306. The extensions 306 and the indentations 307 have the same structure as those explained for the extensions 156 and the indentations 157 of FIG. 10.

One pair of flat portions 305 and extensions 306 has areas extending outward therefrom and corresponding to notches 309 so as to secure an area of formation for the notches 309, which accommodate the lead wires (35) that electrically connect the LED module 3 and the lighting circuit 11.

When seen in a plan view, and with the exception of the portions extending from one pair of the flat portions 305, the outer perimeter (external shape) of the fixing member 301 forms an approximate quadrilateral. Each of the flat portions 305 has a fastening tab 311 projecting downward from a predetermined position on the outer periphery thereof.

The predetermined position corresponds to the midpoint of each edge of the quadrilateral formed by the perimeter of the fixing member 301 as seen in a plan view, or, alternatively, to the outside of the indentation 307 as seen in a plan view. The tip of each fastening tab 311 (the lower edge in FIG. 25A, near the base of the LED light bulb) is, as explained later, a latching portion 313 that latches onto the bottom surface of the mount member 315 upon being fastened (when fastened) thereto.

As shown in FIG. 25B, the mount member 315 is, for instance, round, has a recess in the central portion of the bottom surface thereof (the recess bottom being the contact surface), and constrains the sliding motion of the LED module 3.

As shown in FIG. 25B, the mount member 315 carries the LED module 3 and has through-holes 317 connecting the top and bottom such that the fastening tabs 311 of the fixing member 301 pass therethrough when the fixing member 301 is placed on the LED module 3 with the opening 303 thereof aligned with the light-emitting unit 22 of the LED module 3.

The fixing member 301 is fastened to the mount member 315 as follows. First, the fastening tabs of the fixing member 301 are each passed from the top surface to the bottom surface of the mount member 315 through the through-holes 317. Then, the portion of each fastening tab jutting out from the through-holes 317 is bent so as to latch onto the bottom surface of the mount member 315. The latching portions 313 are formed upon latching.

(6) Materials

In the above-described Embodiments, steel is used as the material of the fixing member. However, other metal materials may, of course, be used, as can resin materials. While the resilience (elasticity) changes as the material is changed, the effect can nevertheless be realized by adjusting the magnitude of the differences in height between the contact surface of the mount member and the top surface of the protrusions, as well as between the contact surface and the flat portions.

2. Mount Member (1) LED Module Regulatory Effect

The mount member pertaining to Embodiment 1 has a recess for the LED (light-emitting) module, while the mount member pertaining to Embodiment 2 has a groove serving to fit the LED module therein. However, the mount member pertaining to the present invention may also have a plurality of structures that separately (independently) regulate the movement of the LED module along and away from the contact surface.

Figure 26A:
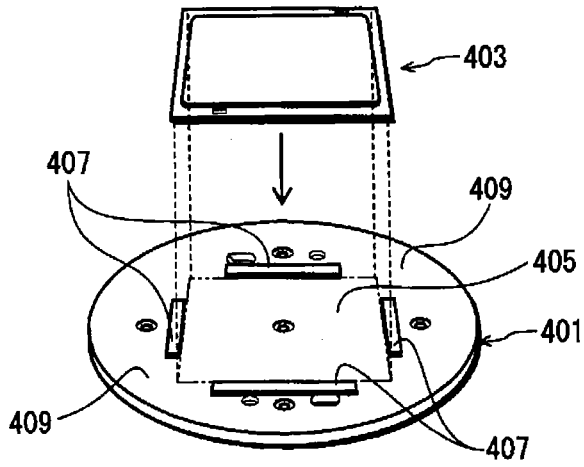
FIGS. 26A and 26B illustrate variations of the mount member, FIG. 26A showing a variation that regulates the sides of the LED module and FIG. 26B showing a variation that regulates the corners of the LED module.
Figure 26B:
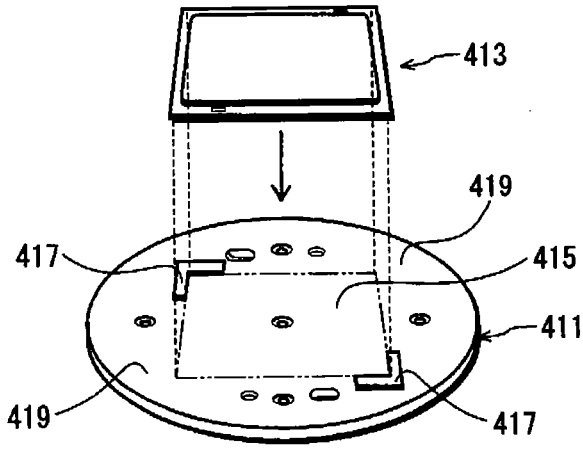

FIGS. 26A and 26B illustrate a variation of the mount member. FIG. 26A shows a case in which the sides of the LED module are regulated, and FIG. 26B shows a case in which the corners of the LED module are regulated.

The mount member 401 pertaining to the variation shown in FIG. 26A has a top surface that is substantially planar and has a contact surface 405 at the center thereof which comes into contact with the LED module 403. Four protruding portions 407 protruding upwards therefrom are arranged at positions along the periphery of the contact surface 405 corresponding to the sides of the LED module 403, which is rectangular when seen in a plan view.

The protruding portions 407 protrude from the periphery of the contact surface 405 and are provided at positions allowing regulation of sliding motion by the LED module 403.

In the present variation, the fixing member (omitted from diagram) may be fastened to the top surface of the protruding portions 407, or, alternatively, may be fastened to a peripheral region of the contact surface 405 within the same plane thereas (such as the region designated with the reference symbol 409).

The mount member 411 pertaining to the variation shown in FIG. 26B has a top surface that is substantially planar, and has a contact surface 415 at the center thereof that comes into contact with the LED module 413. Two protruding portions 417, protruding upwards therefrom are L-shaped when seen in a plan view and are arranged at positions along the periphery of the contact surface 415 corresponding to the corners of the LED module 413, which is rectangular when seen in a plan view. The protruding portions 417 protrude from the periphery of the contact surface 415 and are provided at positions allowing regulation of sliding motion by the LED module 413.

In the present variation, the fixing member (omitted from diagram) may be fastened to a peripheral region of the contact surface 415 within the same place thereas (the upper (top) surface of the mount member) (such as the region designated with the reference symbol 409).

Additionally, the mount member pertaining to the variation illustrated in FIGS. 26A and 26B may be realized by welding the protruding portions, or by compressing molding or similar.

(2) Structure

In the Embodiments, the mount member is plate-like (specifically, shaped as a round plate). However, other shapes and structures are also possible.

Figure 27A:
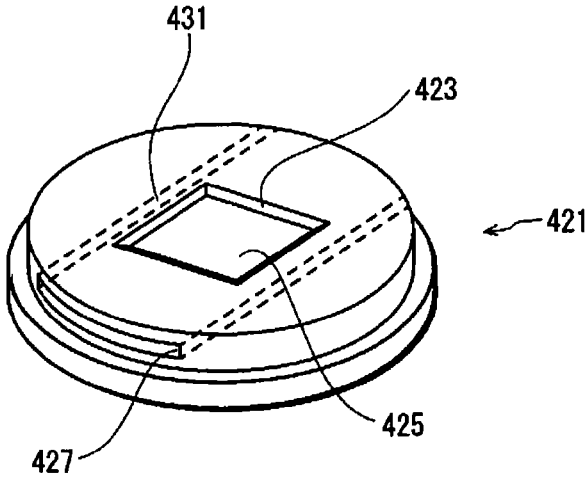
FIGS. 27A, 27B, and 27C illustrate a variation of the mount member, FIG. 27A showing a perspective view of the mount member, FIG. 27B showing a cross-section of the LED module fastened to the mount member, and FIG. 27C showing an expanded view of the fastened portion shown in FIG. 27B.
Figure 27B:
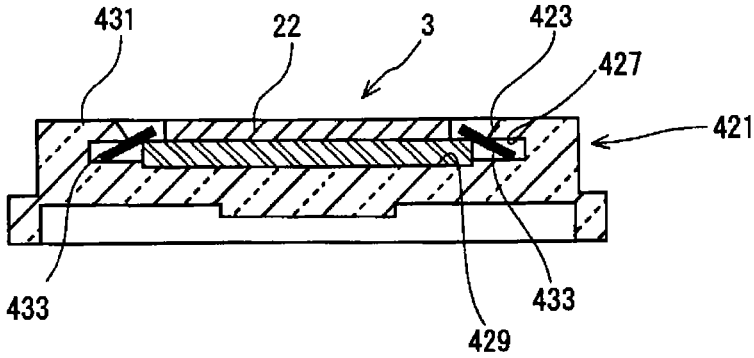
Figure 27C:
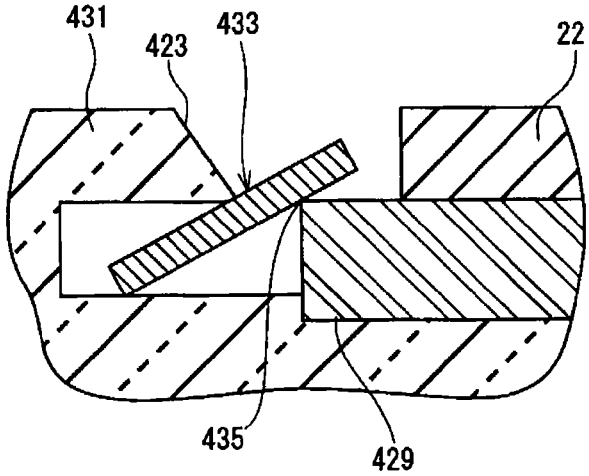

FIGS. 27A, 27B, and 27C illustrate a variation of the mount member. FIG. 27A shows a perspective view of the mount member, FIG. 27B shows a cross-section of the LED module fastened to the mount member, and FIG. 27C is an expanded view of the vicinity of the fixing member as shown in FIG. 27B.

The mount member 421 is round, and structured so as to contain the LED module 3 therein. Specifically, the mount member 421 has a slot 423 with which to contain the LED module 3 and a container 425 that contains the LED module 3 inserted therein through the slot 423.

The container 425 has a rectangular groove 427 formed therein, running from one side of the lateral face of the mount member 421 through the other side thereof.

The central part of the groove 427 has a recessed portion 429 provided in the thickness direction of the mount member 421 (see FIG. 27B). The sliding movement of the LED module 3 is regulated by the recessed portion 429. The bottom face of the recessed portion 429 is the contact surface. The peripheral area of the recessed portion 429, which is the bottom portion of the groove 427, is made to protrude in the thickness direction of with respect to the bottom face of the recessed portion 429, thus corresponding to the regulating portion of the present invention.

As shown in FIG. 27B, the width of the groove 427 is greater than the width of the LED module 3. The slot 423 is slightly larger than the LED module 3, as seen in a plan view. Therefore, gaps arise between the peripheral area 431 of the slot 423 and the LED module 3 held in the container 425.

As described above, the groove 427 is rectangular, and the bottom face thereof is thus parallel to the peripheral area 431. The peripheral area (corresponding to the extended portion of the present invention) 431 is made to project into the vicinity of the light-emitting unit 22 of the LED module 3, leaving a clearance from the bottom face of the groove 427.

The gaps between the peripheral area 431 and the LED module 3 are filled by inserting the fixing member 433 therein. The fixing member 433 is thus fastened upon insertion in the gaps between the LED module 3 and the peripheral area 431.

Here, the force pressing the LED module 3 into the mount member 421 acts on the fixing member 433 such that connectors 435 connecting the fixing member 433 to the LED module 3 press the LED module toward the mount member 421. The LED module 3 is thus fixed onto the mount member 421.

In this example, the fixing member 433 is made up of a plurality (perhaps four) of band-like members. However, these may also be wedge-like members.

3. Illumination Device

In the Embodiments, the LED light bulb is described as an illumination device with the aim of replacing incandescent light bulbs and screw-in fluorescent lamps. However, the illumination device pertaining to the present invention may also be utilized with the aim of replacing other lamps, such as fluorescent lamps that do not comprise a lighting circuit (i.e., compact fluorescent lamps).

In such a case, the LED light bulb detailed for the above-described Embodiments is realized by replacing the base with a predetermined base (such as a G, GX, or GY base) and by excluding the lighting circuit and circuit casing from the case.

4. Other

The above-described Embodiments and variations each have the characteristics thereof detailed separately. However, the configuration of each of the Embodiments and variations may be freely combined with the configuration of any other Embodiments and variations.

INDUSTRIAL APPLICABILITY

The present invention is applicable to the fixing of a light-emitting module on a mount member with a simple structure that involves no increase in weight.

REFERENCE SIGNS LIST

1 LED light bulb (illumination device)
3 LED module (light-emitting module)
5 Mount member
5*a* Top surface
6 Fixing member
7 Case
9 Globe
11 Lighting Circuit
13 Circuit casing
15 Base member
17 Substrate
19 LEDs (light-emitting diodes)
22 Light-emitting unit
27 Recess
27*a* Contact surface
43 Flat portions
44 Flat tabs
215 Connection terminal member

The invention claimed is:

1. An illumination device including a light-emitting module having a substrate and a light-emitting unit mainly constituted by a light-emitting element on a central portion of a top surface of the substrate, the light-emitting module being fixed to a mount member by a pressing member, wherein the mount member has a contact surface in contact with a bottom surface of the light-emitting module mounted thereon, and a regulating portion regulating sliding motions of the light-emitting module in protruding from near the contact surface along the thickness dimension of the light-emitting module, the pressing member is made of a resilient plate-like member and comprises:

flat portions disposed in areas peripheral to the contact surface of the mount member; and one or more flat tabs reaching from the flat portions toward the contact surface and coming into contact with the top surface of the substrate of the light-emitting module, and the pressing member is fastened such that the flat portions come to be positioned lower than the top surface of the substrate of the light-emitting module, thereby causing each flat tab of the pressing member to press the light-emitting module due to forces applied by elastic deformation in a region extending from a fastened area of the flat portions to the flat tab.

2. The illumination device of claim 1, wherein a top surface of the regulating portion of the mount member is lower than the top surface of the substrate, and the flat portions of the pressing member are fastened to the top surface of the regulating portion.

3. The illumination device of claim 1, wherein the flat portions are provided as an opposing pair sandwiching the light-emitting unit therebetween, the flat tabs are individually provided on each of the flat portions, and a total of two flat tabs are positioned so as to exhibit point symmetry about the center of the light-emitting unit.

4. The illumination device of claim 1, wherein the light-emitting module has terminals electrically connected to the light-emitting element provided as an opposing pair at positions not facing the flat portions on the top surface of the substrate, and the terminals are pressed toward the contact surface by the pressing member.

5. The illumination device of claim 4, wherein the terminals of the light-emitting module are electrically connected to a connection terminal member disposed between the pressing member and the substrate of the light-emitting module, and the connection terminal member is pressed toward the contact surface by the pressing member so as to press the terminals of the light-emitting modules.

6. The illumination device of claim 5, wherein the pressing member has a projecting portion that projects between the connection terminal member and the light-emitting unit, and an edge of the projecting portion projects to the substrate or to a vicinity thereof.

* * * * *